US008585449B1

(12) United States Patent
McChesney et al.

(10) Patent No.: US 8,585,449 B1
(45) Date of Patent: Nov. 19, 2013

(54) HYDRAULIC SYSTEM FOR MARINE PROPULSION SYSTEMS

(75) Inventors: Richard McChesney, Waukegan, IL (US); Mark C. Noble, Pleasant Prairie, WI (US); Darrell Wiatrowski, Libertyville, IL (US)

(73) Assignee: BRP US Inc., Sturtevant, WI (US)

( * ) Notice: Subject to any disclaimer, the term of this patent is extended or adjusted under 35 U.S.C. 154(b) by 242 days.

(21) Appl. No.: 13/017,431

(22) Filed: Jan. 31, 2011

Related U.S. Application Data

(60) Provisional application No. 61/299,597, filed on Jan. 29, 2010.

(51) Int. Cl.
*B63H 5/125* (2006.01)

(52) U.S. Cl.
USPC ..... 440/61 R; 440/61 G; 440/61 T

(58) Field of Classification Search
USPC ..... 440/61 A, 61 D, 61 G, 61 R, 61 S, 61 T; 60/421, 475, 476, 484, 486; 303/113.1
See application file for complete search history.

(56) References Cited

U.S. PATENT DOCUMENTS 4,342,164 A * 8/1982 Claassen ..... 60/475
6,394,861 B1 5/2002 Kolb et al.
7,241,194 B2 7/2007 Tawa et al.
7,413,490 B2 8/2008 Tawa et al.
7,516,613 B2 * 4/2009 Kadlicko ..... 60/414
7,942,711 B1 * 5/2011 Swan ..... 440/61 D

FOREIGN PATENT DOCUMENTS

JP 1019107 A 1/1989
JP 2006137225 A 6/2006

OTHER PUBLICATIONS

English abstract of JP 2006137225, Jun. 1, 2006.
English abstract of JP 1019107, Jan. 23, 1989.

* cited by examiner

*Primary Examiner* — Lars A Olson
(74) *Attorney, Agent, or Firm* — BCF LLP

(57) ABSTRACT

A hydraulic system for a marine propulsion system comprises an actuator adapted for moving at least a portion of the propulsion system between a first position and a second position. A first pump is selectively communicating with the actuator by a first fluid line. The first pump supplies hydraulic fluid via the first fluid line to the actuator for moving the at least portion of the propulsion system towards the first position. A second pump selectively fluidly communicates with the actuator by a second fluid line. The second pump supplies hydraulic fluid via the second fluid line to the actuator for moving the at least portion of the propulsion system towards the second position. An electronic control unit (ECU) electrically connected to the first pump and to the second pump for controlling the operation of the first pump and the second pump.

25 Claims, 15 Drawing Sheets

HYDRAULIC SYSTEM FOR MARINE PROPULSION SYSTEMS

CROSS-REFERENCE

The present application claims priority to U.S. Provisional Application Ser. No. 61/299,597, filed Jan. 29, 2010, and entitled 'Hydraulic System for Marine Propulsion Systems', the entirety of which is incorporated herein by reference.

TECHNICAL FIELD

The present invention relates to hydraulic systems for marine propulsion systems.

BACKGROUND

Marine outboard engines have various systems that are necessary for their operation, or at least to facilitate and/or improve their operation. Such systems are for example, steering systems to steer the outboard engine, tilt and trim systems to adjust the vertical orientation of the outboard engine, throttle control systems to control the power generated by the engine, shifting systems to shift the direction of rotation of a propeller of the outboard engine, and variable pitch propeller systems to change the pitch of the propeller blades of the propeller.

Most of today's marine outboard engines have two or more of the above systems. Actuation of these systems can be done in different ways such as electrically (with electric motors or solenoids), mechanically (with linkages or push-pull cables), or with the use of hydraulic actuators.

FIG. 1 shows a typical hydraulic system 100' using a hydraulic actuator 106'. The hydraulic system 100' comprises a single pump 102' electrically connected to an Electronic Control Unit (ECU) 104' by connection 135'. The single pump 102' supplies hydraulic fluid to the actuator 106' for performing two actions. In the case of a steering system, the two actions performed by the actuator 106' are steering right and left. In the case of a tilt/trim system, the two actions performed by the actuator 106' are tilting up and down. A reservoir 105' supplies the pump 102' with hydraulic fluid. The pump 102' connects to the actuator 106' by a first fluid line 110*a*' and by a second fluid line 110*b*'. The actuator 106' is a piston-cylinder assembly comprising a first side 112*a*' and a second side 112*b*' (one side 112*a*' or 112*b*' for each action). Common types of actuators 106' include linear displacement hydraulic actuators, or rotary hydraulic actuators. When the first fluid line 110*a*' supplies the first side 112*a*' of the actuator 106' with hydraulic fluid, hydraulic pressure forces the first side 112*a*' to expand which causes a steering motion in a first direction (e.g. port turn). When the second fluid line 110*b*' supplies the second side 112*b*' with hydraulic fluid, hydraulic pressure forces the second side 112*b*' to expand which causes a steering motion in a second direction (e.g. starboard turn). Valves 115*a*', 115*b*' are positioned on fluid lines 110*a*', 110*b*' respectively. The valves 115*a*', 115*b*' are two-ways valves. They control which side of the piston-cylinder assembly is fed by the pump 102', and also control the return of hydraulic fluid from the actuator 106'. The valves 115*a*', 115*b*' are electrically connected to the ECU 104' which operates them by connection 137*a*' and 137*b*'. The valves 115*a*' and 115*b*' are fluidly connected to the reservoir 106' for the return of fluid by connections 139*a*' and 139*b*'.

Hydraulic systems, such as the hydraulic system 100', rely on a single pump. When the pump fails, the actuator can no longer operate. In addition, the pump is limited in size for engine packaging reasons. Also, some manoeuvres require high volume flow rate that often exceed what the single pump can provide. Finally, when the single pump is designed for delivering high volume flow rates, packaging becomes cumbersome.

Therefore, there is a need for a hydraulic system that can provide pressurized fluid to the hydraulic actuator even if a pump fails or is deficient.

There is also a need for a hydraulic system that is able to provide sufficient hydraulic fluid when the level of hydraulic fluid required to perform an action is high.

Finally, there is a need for a hydraulic system that can be easily packaged within the constraints associated with outboard engines.

SUMMARY

It is an object of the present invention to ameliorate at least some of the inconveniences present in the prior art.

It is also an object to provide a hydraulic system that has two distinct pumps, each pump being associated with one of the actions of the actuator.

It is also an object of the present invention to provide a hydraulic system having two pumps and a valve assembly. The valve assembly redirects flow delivered by one of the pump to support flow that is delivered or should have been delivered by the other pump.

In one aspect, the invention provides a hydraulic system for a marine propulsion system comprising an actuator adapted for moving at least a portion of the propulsion system between a first position and a second position. A first pump is selectively communicating with the actuator by a first fluid line. When in operation the first pump is supplying hydraulic fluid via the first fluid line to the actuator for moving at least the portion of the propulsion system towards the first position. A second pump is selectively fluidly communicating with the actuator by a second fluid line. When in operation the second pump is supplying hydraulic fluid via the second fluid line to the actuator for moving at least the portion of the propulsion system towards the second position. An electronic control unit (ECU) is electrically connected to the first pump and to the second pump for controlling the operation of the first pump and the second pump.

In a further aspect, a third fluid line is selectively communicating the first pump to the actuator for moving at least the portion of the propulsion system towards the second position respectively. At least one sensor is sensing at least one of hydraulic pressure and flow rate in the second fluid line. When the ECU receives a signal from the at least one sensor indicative of at least one of hydraulic pressure and flow rate in the second fluid line being insufficient for moving at least the portion of the propulsion system toward the second position, the ECU sends a signal to the first pump to supply hydraulic fluid via the third fluid line to the actuator for moving at least the portion of the propulsion system towards the second position.

In a further aspect, a fourth fluid line is selectively communicating the second pump to the actuator for moving at least the portion of the propulsion system towards the first position. The at least one sensor is sensing at least one of hydraulic pressure and flow rate in the first fluid line. When the ECU receives a signal from the at least one sensor indicative of at least one of hydraulic pressure and flow rate in the first fluid line being insufficient for moving at least the portion of the propulsion system toward the first position, the ECU sends a signal to the second pump to supply hydraulic fluid via the fourth fluid line to the actuator for moving at least the portion of the propulsion system towards the first position.

In a additional aspect, the signal from the at least one sensor indicative of at least one of hydraulic pressure and flow rate in the first fluid line being insufficient for moving at least the portion of the propulsion system toward the first position is indicative of the first pump not functioning properly. The signal from the at least one sensor indicative of at least one of hydraulic pressure and flow rate in the second fluid line being insufficient for moving at least the portion of the propulsion system toward the second position is indicative of the second pump not functioning properly.

In a further aspect, the first pump and the second pump are bi-directional pumps.

In a further aspect, a valve assembly is electrically connected to the ECU. The valve assembly selectively is fluidly communicating the first fluid line with the second fluid line.

In an additional aspect, at least one sensor is electrically connected to the ECU. The ECU determines a proper operation of the first and the second pumps based on at least a signal from the at least one sensor.

In a further aspect, a first pressure sensor is fluidly connected to the first fluid line. A second pressure sensor is fluidly connected to the second fluid line.

In an additional aspect, when the ECU receives a signal from the at least one sensor indicative of at least one of hydraulic pressure and flow rate in the first fluid line being insufficient for moving at least the portion of the propulsion system toward the first position, the ECU sends a signal to the valve assembly to redirect hydraulic fluid from the second fluid line toward the first fluid line, and the ECU sends a signal to the second pump to operate.

In a further aspect, at least one valve is positioned on the second fluid line. When the at least one valve is in a closed position, the at least one valve prevents flow in the second fluid line toward the actuator. When the ECU receives a signal from the at least one sensor of hydraulic pressure in the first fluid line being insufficient for moving at least the portion of the propulsion system toward the first position, the ECU sends a signal to close the at least one valve to prevent hydraulic fluid to flow in the second fluid line toward the actuator.

In an additional aspect, the valve assembly comprises the at least one valve.

In an additional aspect, the signal from the at least one sensor indicative of at least one of hydraulic pressure and flow rate in the first fluid line being insufficient for moving at least the portion of the propulsion system toward the first position is indicative of the first pump not functioning properly.

In a further aspect, when the ECU receives a signal from the at least one sensor indicative of at least one of hydraulic pressure and flow rate in the second fluid line being insufficient for moving the at least portion of the propulsion system toward the second position, the ECU sends a signal to the valve assembly to redirect hydraulic fluid from the first fluid line toward the second fluid line. The ECU sends a signal to the first pump to actuate. A combined action of the valve assembly redirecting hydraulic fluid toward the second fluid line and an actuation of the first pump resulting in moving the at least portion of the propulsion system toward the second position.

In an additional aspect, at least one valve is positioned on the first fluid line. When the at least one valve is in a closed position the at least one valve prevents flow in the second fluid line toward the actuator. When the ECU receives a signal from the at least one sensor of hydraulic pressure in the second fluid line being insufficient for moving at least the portion of the propulsion system toward the second position, the ECU sends a signal to close the at least valve to prevent hydraulic fluid to flow in the first fluid line toward the actuator.

In a further aspect, the valve assembly comprises the at least one valve.

In a further aspect, the signal from the at least one sensor indicative of at least one of hydraulic pressure and flow rate in the second fluid line being insufficient for moving at least the portion of the propulsion system toward the second position is indicative of the second pump not functioning properly.

In an additional aspect, the actuator is one of a linear and a rotary actuator. The actuator includes a piston disposed in a cylinder. The first fluid line is supplying hydraulic fluid in the cylinder to a first side of the piston. The second fluid line is supplying hydraulic fluid in the cylinder to a second side of the piston.

In a further aspect, the first and second pumps include an electric motor.

In an additional aspect, the actuator controls at least one of a steering system, a tilt-trim system, and a variable pitch propeller actuation system.

In a further aspect, at least one reservoir in fluid communication with at least one of the first pump and the second pump.

In an additional aspect, the hydraulic system is adapted to be located in a tilt/trim bracket of a watercraft.

In a further aspect, the first position of the propulsion system is in a different direction from the second position of the propulsion system.

In an additional aspect, the first position of the propulsion system is opposite to the second position of the propulsion system.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Figure 1:
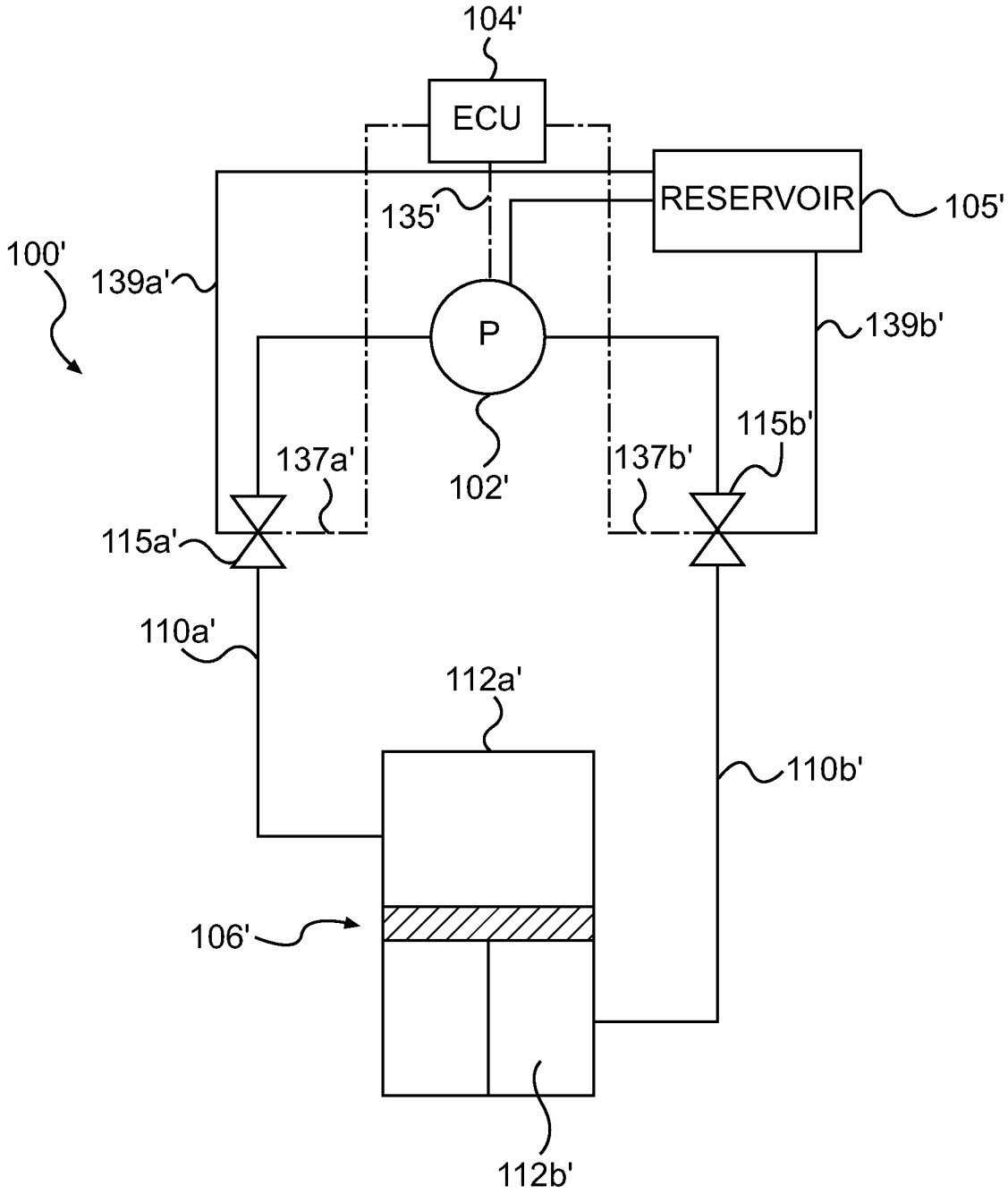
FIG. 1 PRIOR ART
FIG. 1 is a schematic illustration of a hydraulic system of the prior art.

FIGS. 2-3 and 7A-9C schematically represent hydraulic systems according to the present invention. Throughout these figures, dash-dotted connections lines between elements refer to electric and/or electronic/digital connections while solid connections lines (no arrow) refer to fluidic or hydraulic connections.

The hydraulic systems will be described with reference to a steering system 30 of a watercraft 10 (shown in FIG. 8). It should be understood that the hydraulic systems could be used in applications other than steering such as a tilt/trim system 10 (shown in FIG. 10), a shifting system or a variable pitch propeller system 20 (shown in FIG. 9). It is also contemplated that the hydraulic systems could be used on other parts of the watercraft 10 not related to a propulsion system. For example, the hydraulic systems could be used to elevate or lower a tower of the watercraft 1.

Figure 2:
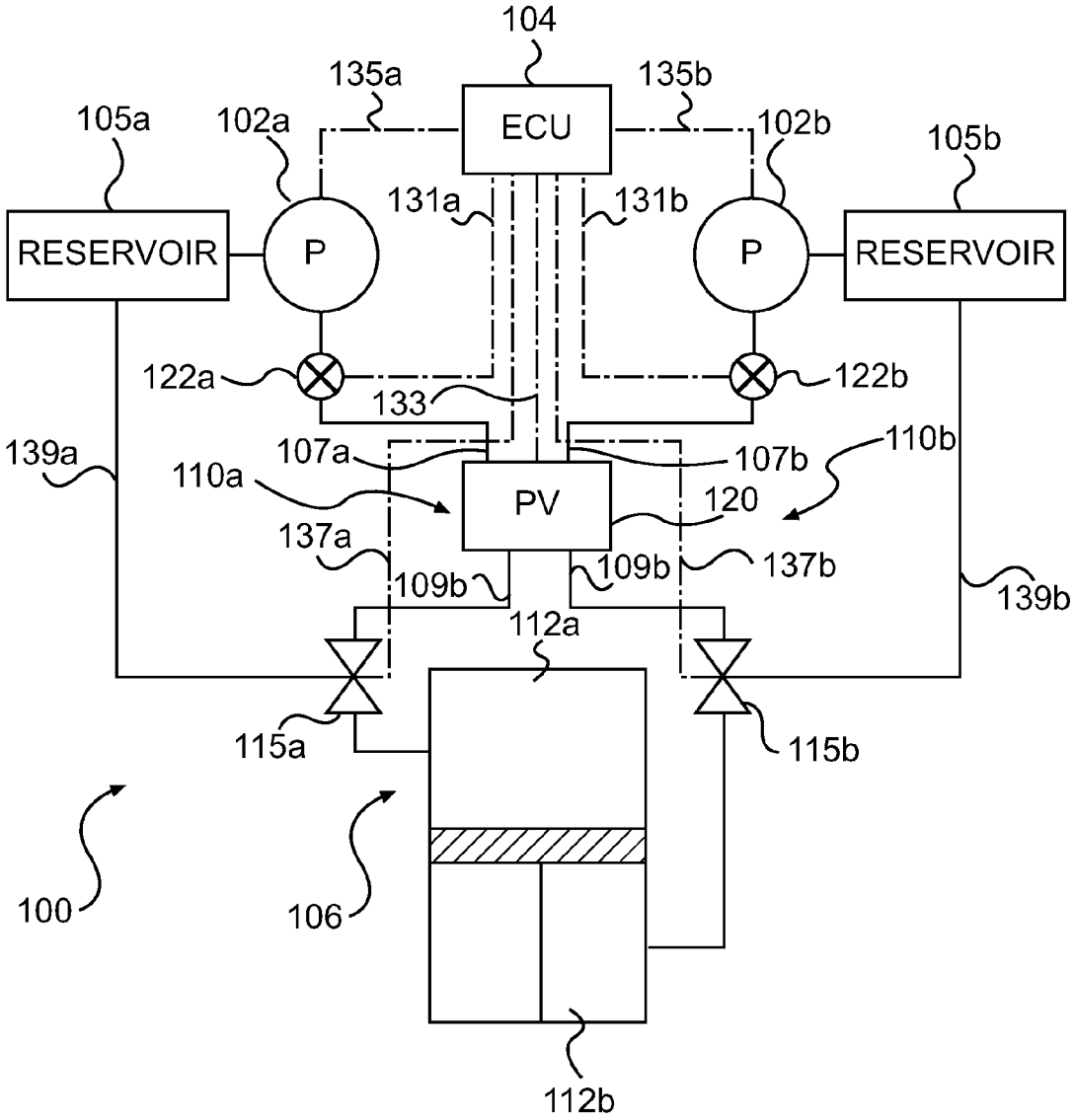
FIG. 2 is a schematic illustration of a hydraulic system according to a first embodiment of the invention.

Turning to FIG. 2, a hydraulic system 100 according to a first embodiment of the invention will be described.

The hydraulic system 100 has two distinct pumps, a first pump 102*a* and a second pump 102*b*. The pumps 102*a*, 102*b* include an electric motor. Each pump 102*a*, 102*b* is connected to a different side 112*a*, 112*b* of an actuator 106. A valve assembly 120 is disposed on fluid lines 110*a*, 110*b* between the pumps 102*a*, 102*b* and the actuator 106. As will be described below, the valve assembly 120 is used for directing flow between the fluid lines 110*a* and 110*b*. The valve assembly 120 is an assembly of valves and connecting fluid lines. It is contemplated that some of the valves comprised in the valve assembly 120 could be disposed remotely from the other valves, but would still be considered part of the valve assembly 120. Conversely, the valve assembly 120 could be a single unit element. The valve assembly 120 is electrically connected to an ECU 104 by a connection 133. Depending on an action requested by an operator (driver of the watercraft 10) such as turning port or starboard and/or depending on hydraulic pressure in the fluid lines 110*a* and 110*b*, the ECU 104 communicates with the valve assembly 120 to redirect flow where and when needed. The valve assembly 120 as well as modes of operation of the valve assembly 120 will be described in greater details below.

The first pump 102*a* is electrically connected to the ECU 104 by connection 135*a*, and the second pump 102*b* is electrically connected to the ECU 104 by connection 135*b*. The first pump 102*a* and the second pump 102*b* are fluidly connected to reservoirs 105*a* and 105*b* respectively. It is contemplated that reservoirs 105*a* and 105*b* could be fluidly connected to each other. It is further contemplated that the reservoirs 105*a*, 105*b* could be a single common reservoir. The actuator 106 is a piston-cylinder assembly comprising a first side 112*a* and a second side 112*b*. It is contemplated that the actuator 106 could be a linear actuator (as shown) or a rotary actuator connected to the steering system 30 for operating it.

Figure 3:
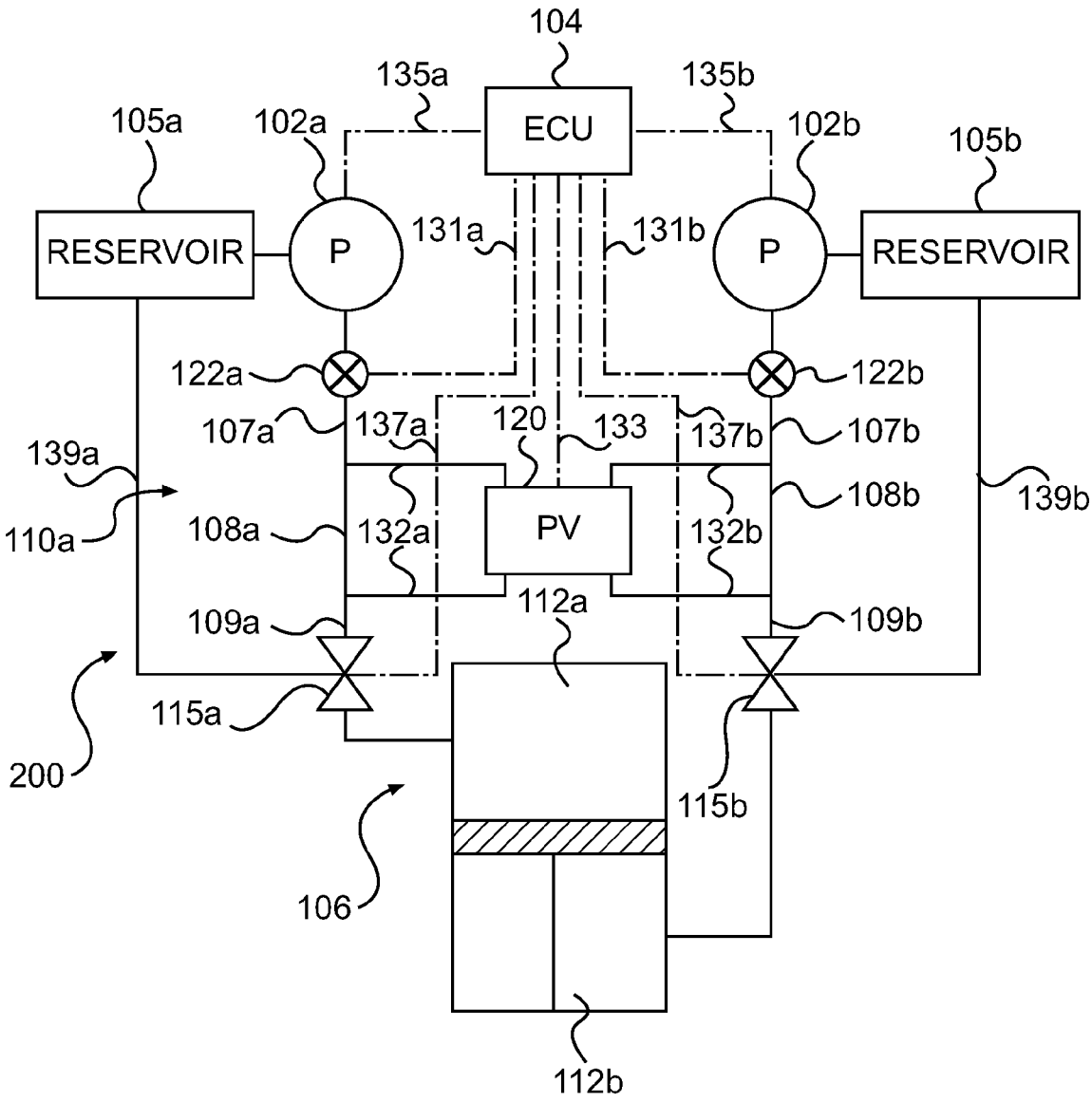
FIG. 3 is a schematic illustration of a hydraulic system according to a second embodiment of the invention.

The fluid lines 110*a*, 110*b* comprise first sections 107*a*, 107*b* connecting a corresponding pump 102*a*, 102*b* with the valve assembly 120. The fluid lines 110*a*, 110*b* comprise second sections 108*a*, 108*b* running through the valve assembly 120 (shown in FIGS. 4A to 6B). Finally the fluid lines 110*a*, 110*b* comprise third sections 109*a*, 109*b* connecting the valve assembly 120 with a corresponding side 112*a*, 112*b* of the actuator 106. It is contemplated that fluid lines 110*a*, 110*b* could be several fluid lines connected to each other to form a single fluid line. FIG. 3 shows a second embodiment of a hydraulic system 200 wherein the first fluid line 110*a* and the second fluid line 110*b* connect the valve assembly 120 via two intermediary fluid lines 132*a*, 132*b*.

Hydraulic pressure in the first fluid line 110*a* is measured by a first sensor 122*a* disposed on to the first section 107*a* of the fluid line 110*a*. Hydraulic pressure in the second fluid line 110*b* is measured by a second sensor 122*b* disposed on the first section 107*a* of the second fluid line 108*b*. The first sensor 122*a* and the second sensor 122*b* are electrically connected to the ECU 104 by connections 131*a* and 131*b* respectively. It is contemplated that the sensors 122*a*, 122*b* could be omitted, and that the valve assembly 120 could be controlled to direct flow by other means than signals sent by the sensors 122*a*, 122*b* to the ECU 104. It is further contemplated that the sensors 112*a* and 122*b* could be disposed at another location on the fluid lines 110*a* and 110*b*. It is also contemplated that the sensors 122*a* and 122*b* could not be hydraulic fluid pressure sensors. For example, the sensors 122*a*, 122*b* could be hydraulic fluid flow meters, or position sensors, ammeters, angular sensors, GPS or accelerometers sensing position or change in position of the actuator 106 or other part of the propulsion system to name a few, or a combination of at least some of the above. In these alternative designs, the sensors 122*a*, 122*b* may not be located on the fluid lines 110*a*, 110*b*. For example, they could be located on the pump 102*a*, 102*b*, on the actuator 106, on the steering system 30, on the tilt/trim system 12, on a driver's console of the watercraft 10, or on a variable pitch propeller 20 (shown in FIG. 9), as the case may be.

Valves 115*a* and 115*b* are disposed on the third sections 109*a*, 109*b* of the fluid lines 110*a* and 110*b* respectively. The valves 115*a*, 115*b* are two ways valves controlled by the ECU 104 by the connections 137*a*, 137*b* respectively. The valves 115*a*, 115*b* are fluidly connected to the reservoirs 105*a*, 105*b* by connections 139*a*, 139*b* respectively. In one of the two ways, the valve 115*a* (resp. 115*b*) lets hydraulic fluid from the third section 109*a* (resp. 109*b*) of the fluid line 110*a* (resp. 110*b*) flow to the side 112*a* (resp. 112*b*) of the actuator 106. In another one of the two ways, the valve 115*a* (resp. 115*b*) lets hydraulic fluid from the side 112*a* (resp. 112*b*) of the actuator 106 flow to the fluid line 139*a* (resp. 139*b*) to return to the reservoir 105*a* (resp. 105*b*). It is contemplated that the valves 115*a*, 115*b* could not be actuated by the ECU 104, but could be actuated by difference of pressure. For example, when pressure is positive (flow toward the side 112*a* of the actuator 106), the valve 115*a* would allow flow to reach the actuator 106, and when the pressure is negative (flow toward the pump 102*a*), the valve 115*a* would allow flow to reach the reservoir 105*a*. Return of hydraulic fluid from the actuator 106 to the reservoirs 105*a*, 105*b* will be shown later with respect to FIGS. 7A and 7B.

Turning now to FIGS. 4A to 6B, the valve assembly 120 and modes of operation of the valve assembly 120 will be described. Throughout FIGS. 4A to 6B, hydraulic fluid coming from the first pump 102*a* will be illustrated by an arrowed solid line and hydraulic fluid coming from the second pump 102*b* will be illustrated by an arrowed dashed line. Direction of flow is indicated by the direction of the arrow. The terms 'upstream' and 'downstream' are used herein in their common sense with respect to the flow direction indicated by the arrows. Although a specific valve assembly 120 will be described, it should be understood, that other devices having the capability of redirecting flow and optionally controlling the redirected flow could be used. In the valve assembly 120 illustrated in FIGS. 4A-6B, the fluid lines 110*a* and 110*b* pass directly through the valve assembly 120 such as illustrated in FIG. 2 for the hydraulic system 100. However, it should be understood that the same valve assembly 120 could be used in the hydraulic system 200 by connecting the valve assembly 120 to the intermediary fluid lines 132*a*, 132*b*. In that case, FIGS. 4A-6B would remain the same except the lines 108*a* and 108*b* be replaced by lines 132*a* and 132*b* respectively, and valves 116*a*, 116*b* would be positioned on the third sections 109*a*, 109*b* of the fluid lines 110*a*, 110*b*. It is contemplated that when the valves 116*a*, 116*b* are positioned on the third sections 109*a*, 109*b*, the valves 116*a*, 116*b* could provide the function provided by valves 115*a*, 115*b*, and as a result, valves 115*a*, 115*b* could be omitted.

A first bridge fluid line 141 and a second bridge fluid line 143 connect the second sections 108*a*, 108*b* of the corresponding fluid lines 110*a* and 110*b* to each other. The first bridge fluid line 141 selectively communicates the first fluid line 108*a* with the second fluid line 110*b* with the use of a valve 144 positioned upstream of a one way valve 140. The one way valve 140 allows fluid from the second fluid line 110*b* to flow in the first fluid line 110*a*, and prevents fluid from the first fluid line 110*a* to flow in the second fluid line 110*b*. The second bridge fluid line 143 selectively communicates the first fluid line 110*a* with the second fluid line 110*b* with the use of a valve 146 positioned upstream of a one way valve 142. The one way valve 142 allows fluid from the first fluid line 110*a* to flow in the second fluid line 110*b*, and prevents fluid from the second fluid line 110*b* to flow in the first fluid line 110*a*. Therefore, in the bridge fluid lines 141, 143, flow occurs only in one direction. The valves 144, 146 are operated via the ECU 104 to allow or prevent (opened position and closed position respectively) fluid from the second fluid line 110*b* to pass through the one way valve 140 and fluid from the first fluid line 110*a* to pass through the one way valve 142 respectively. The valves 116*a* and 116*b* are electrically connected to the ECU 104, and control communication of hydraulic fluid through the fluid lines 110*a*, 110*b* and their corresponding sides 112*a*, 112*b* of the actuator 106.

Figure 4A:
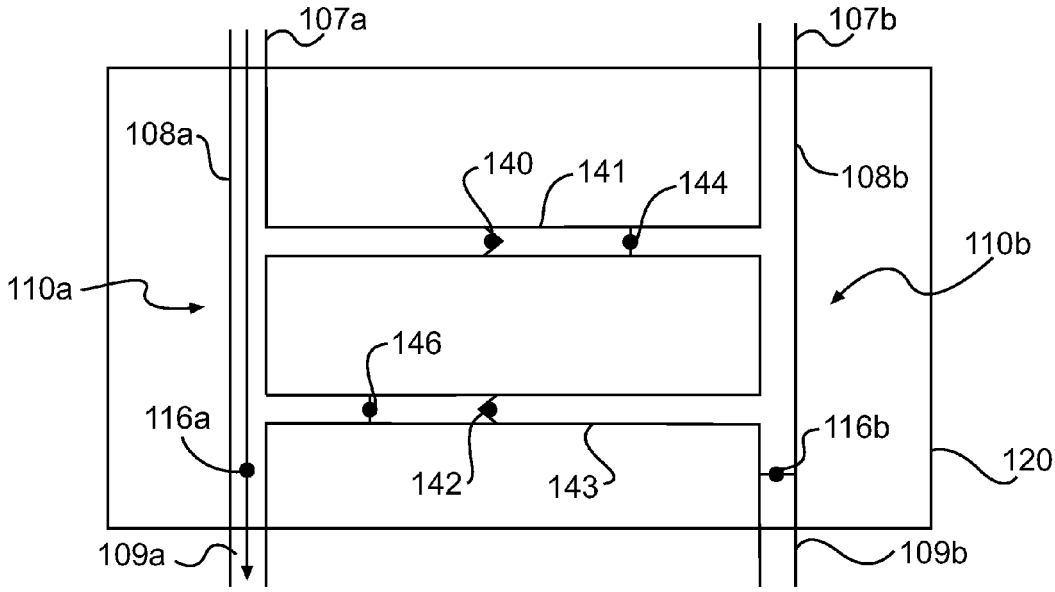
FIG. 4A is a schematic illustration of flow of hydraulic fluid supplied by a first pump (indicated by solid arrows) through a valve assembly to a first side of an actuator of the hydraulic system of FIG. 2, according to a first mode of operation of the valve assembly.
Figure 4B:
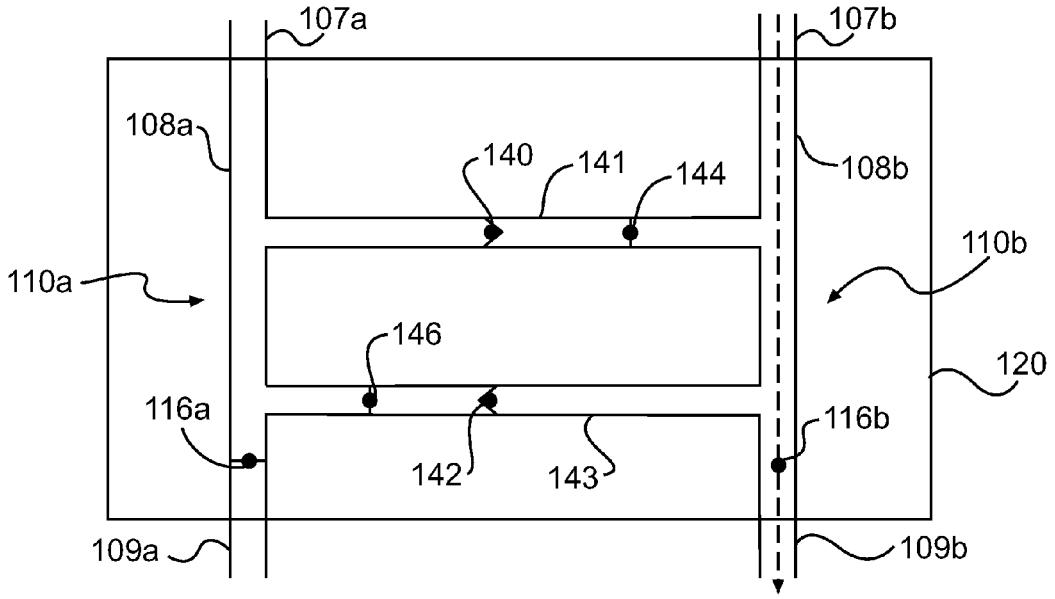
FIG. 4B is a schematic illustration of flow of hydraulic fluid supplied by a second pump (indicated by dashed arrows) through the valve assembly to a second side of the actuator of the hydraulic system of FIG. 2, according to the first mode of operation of the valve assembly.

Turning now more specifically to FIGS. 4A and 4B, a first mode of operation of the valve assembly 120 will be described. The first mode corresponds to the valve assembly 120 supplying hydraulic fluid to the actuator 106 for making a normal port or starboard turn. In the first mode, only one of the pumps 102*a*, 102*b* is actuated. The actuated pump 102*a* or 102*b* supplies hydraulic fluid to the corresponding side 112*a* or 112*b* of the actuator 106. The valve assembly 120 connects the first section 107*a* or 107*b* of the fluid line 110*a* or 110*b* of the actuated pump 102*a* or 102*b* with a corresponding third section 109*a* or 109*b* of the fluid line 110*a* or 110*b*. The fluid lines 110*a*, 110*b* do not fluidly communicate with each other, and as such no hydraulic fluid is being redirected from one fluid line 110*a*, 110*b* to the other.

In FIG. 4A, the valve assembly 120 is in a position for causing the actuator 106 to make a normal port turn. Hydraulic fluid coming from the first pump 102*a* is supplied to the first side 112*a* of the actuator 106.

When the operator acts on the watercraft 10 to make a normal port turn and a signal sent by the sensor 122*a* indicates normal operation of the first pump 102*a*, the ECU 104 sends a signal to the valve assembly 120 via the connection line 133 to be in a configuration where the valve 146 is in a closed position, the valve 116*a* is in the opened position, the valve 144 is in the closed position, and the valve 116*b* is in the closed position. By doing so, the valve assembly 120 connects the first section 107*a* of the first fluid line 110*a* to the third section 109*a* of the first fluid line 110*a* via the second section 108*a* of the first fluid line 110*a*. No hydraulic fluid flows in the first 107*b*, second 108*b*, and third 109*b* sections of the second fluid line 110*b*.

The valve 116*a* is in the opened position to connect the second section 108*a* with the third section 109*a* of the first fluid line 110*a*. The valve 116*b* is in the closed position for preventing hydraulic fluid in the second section 108*b* of the fluid line 110*b* to flow toward the second side 112*b* of the actuator 106.

Hydraulic fluid flows to the valve assembly 120 via the first section 107*a* of the first fluid line 110*a* only, and exits the valve assembly 120 via the third section 109*a* of the first fluid line 110*a*, for flowing toward the first side 112*a* of the actuator 106.

In FIG. 4B, the valve assembly 120 is in a position for causing the actuator 106 to make a normal starboard turn. Hydraulic fluid coming from the second pump 102*b* is supplied to the second side 112*b* of the actuator 106.

When the operator acts on the watercraft 10 to make a normal starboard turn and a signal sent by the sensor 122*b* indicates normal operation of the second pump 102*b*, the ECU 104 sends a signal to the valve assembly 120 via the connection line 133 to be in a configuration where the valve 144 is in a closed position, the valve 116*b* is in the opened position, the valve 146 is in the closed position, and the valve 116*a* is in the closed position. By doing so, the valve assembly 120 connects the first section 107*b* of the second fluid line 110*b* to the third section 109*b* of the second fluid line 110*b* via the second section 108*b* of the first fluid line 110*b*. No hydraulic fluid flows in the first 107*a*, second 108*a*, and third 109*a* sections of the first fluid line 110*a*.

The valve 116*b* is in the opened position to connect the second section 108*b* with the third section 109*b* of the second fluid line 110*b*. The valve 116*a* is in the closed position for preventing hydraulic fluid in the second section 108*a* of the fluid line 110*a* to flow toward the first side 112*a* of the actuator 106.

Hydraulic fluid flows to the valve assembly 120 via the first section 107*b* of the second fluid line 110*b* only, and exits the valve assembly 120 via the third section 109*b* of the second fluid line 110*b*, for flowing toward the second side 112*b* of the actuator 106.

Figure 5A:
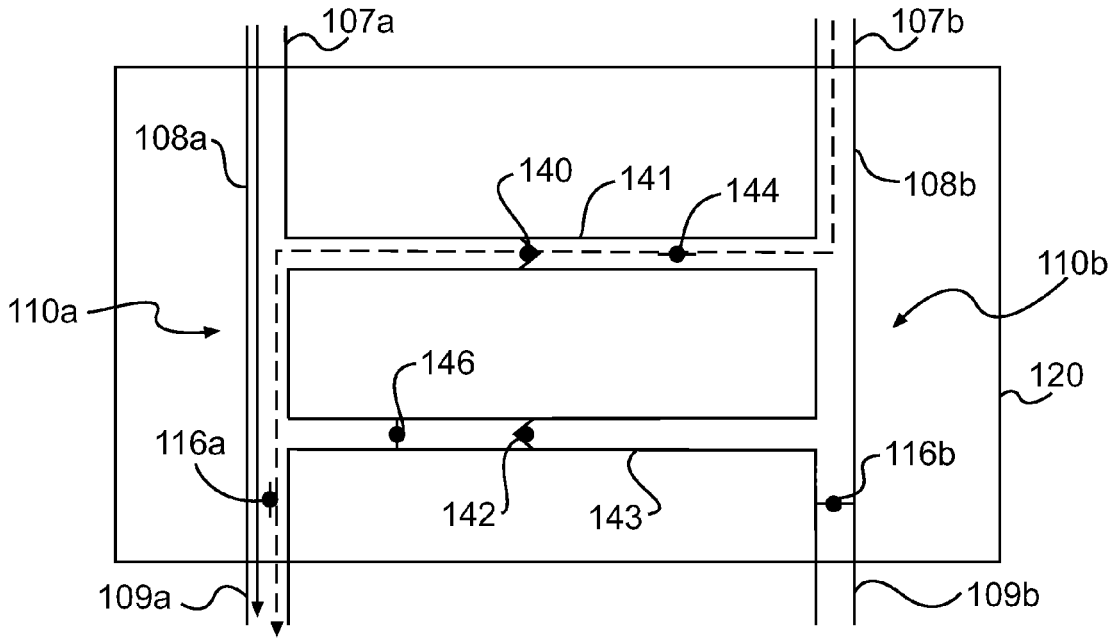
FIG. 5A is a schematic illustration of flow of hydraulic fluid supplied by the first and the second pumps (indicated by solid and dashed arrows respectively) through the valve assembly to the second side of the actuator of the hydraulic system of FIG. 2, according to a second mode of operation of the valve assembly.
Figure 5B:
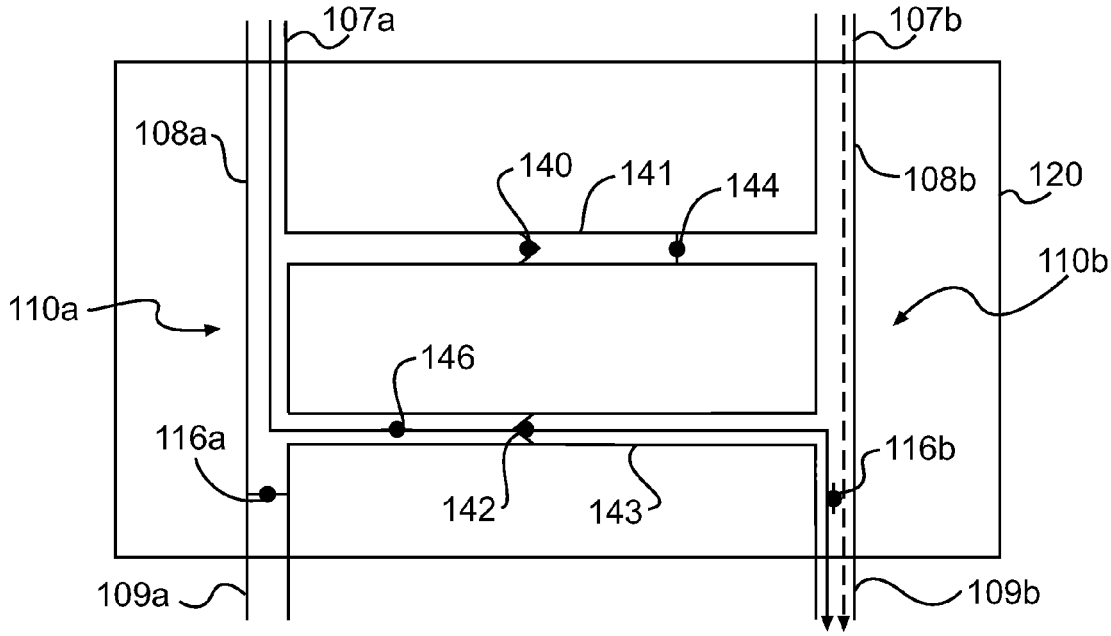
FIG. 5B is a schematic illustration of flow of hydraulic fluid supplied by the first and the second pumps (indicated by solid and dashed arrows respectively) through the valve assembly to the second side of the actuator of the hydraulic system of FIG. 2, according to the second mode of operation of the valve assembly.

Turning now to FIGS. 5A and 5B, a second mode of operation of the valve assembly 120 will be described. The second mode corresponds to one of the pumps 102*a*, 102*b* providing insufficient hydraulic pressure to effect a turn and the valve assembly 120 redirecting hydraulic fluid from the other pump 102*b*, 102*a* to supply the side of the actuator 106 to assists the deficient pump 102*a*, 102*b* in order to make the turn.

In FIG. 5A, the valve assembly 120 is in a position for redirecting hydraulic fluid from the second fluid line 110*b* toward the first fluid line 110*a* to supply the first side 112*a* of the actuator 106 for making a port turn when the pump 102*a* operates (albeit not properly) but does not supply sufficient hydraulic pressure to effect the turn.

When the operator acts on the watercraft 10 to make a port turn and a signal sent by the sensor 122*a* indicates abnormal functioning of the first pump 102*a*, the ECU 104 sends a signal to the pump 102*b* to operate and to the valve assembly 120 to be in a configuration where the valve 144 is in the opened position, the valve 146 is in the closed position, the valve 116*a* is in the opened position, and the valve 116*b* is in the closed position. By doing so, the first fluid line 141 redirects hydraulic fluid from the second fluid line 110*b* toward the first fluid line 110*a*. Hydraulic fluid enters the valve assembly 120 via the first sections 107*a*, 107*b* of the fluid lines 110*a*, 110*b*, and exits the valve assembly via the third section 109*a* of the first fluid line 110*a* only for flowing toward the first side 112*a* of the actuator 106.

In the first bridge fluid line 141, hydraulic fluid of the second fluid line 110*b* communicates with hydraulic fluid of the first fluid line 110*a* due to the valve 144 being in the opened position. It is contemplated that the valve 144 could be partially open for allowing only a fraction of the hydraulic fluid from the second fluid line 110*b* to flow in the first fluid line 110*a*. In the second bridge fluid line 143, hydraulic fluid of the fluid line 110*b* does not communicate with hydraulic fluid of the fluid line 110*a* due to the one way valve 142 and the valve 146 being in the closed position.

The valve 116*a* is in the opened position to connect the second section 108*a* with the third section 109*a* of the first fluid line 110*a*. The valve 116*b* is in the closed position for preventing hydraulic fluid in the second section 108*b* of the fluid line 110*b* to flow toward the second side 112*b* of the actuator 106.

When the operator acts on the watercraft 10 to make a starboard turn and the first pump 102*a* is deficient, the ECU 104 operates the valve assembly 120 to be in the position for making a normal starboard turn as described in FIG. 4B.

In FIG. 5B, the valve assembly 120 is in a position for redirecting hydraulic fluid from the first fluid line 110*a* toward the second fluid line 110*b* to supply the second side 112*b* of the actuator 106 for making a starboard turn when the pump 102*b* operates (albeit not properly) but does not supply sufficient hydraulic pressure to effect a turn.

When the operator acts on the watercraft 10 to make a starboard turn and a signal sent by the sensor 122*b* indicates abnormal functioning of the second pump 102*b*, the ECU 104 sends a signal to the valve assembly 120 to be in a configuration where the valve 146 is in the opened position, the valve 144 is in the closed position, the valve 116*b* is in the opened position, and the valve 116*a* is in the closed position. By doing so, the second fluid line 143 redirects hydraulic fluid from the first fluid line 110*a* toward the second fluid line 110*b*. Hydraulic fluid enters the valve assembly 120 via the first sections 107*a*, 107*b* of the fluid lines 110*a*, 110*b*, and exits the valve assembly via the third section 109*b* of the second fluid line 110*b* only for flowing toward the second side 112*b* of the actuator 106.

In the first bridge fluid line 141, hydraulic fluid of the fluid line 110*a* does not communicate with hydraulic fluid of the fluid line 110*b* due to the valve 144 being in the closed position. In the second bridge fluid line 143, hydraulic fluid of the first fluid line 110*a* communicates with hydraulic fluid of the second fluid line 110*b* due to the one way valve 142 and the valve 146 being in the opened position. It is contemplated that the valve 146 could be partially open for allowing on a fraction of the hydraulic fluid from the first fluid line 110*a* to flow in the second fluid line 110*b*.

The valve 116*b* is in the opened position to connect the second section 108*b* with the third section 109*b* of the second fluid line 110*b*. The valve 116*a* is in the closed position for preventing hydraulic fluid in the second section 108*a* of the fluid line 110*a* to flow toward the first side 112*a* of the actuator 106.

When the operator acts on the watercraft 10 to make a port turn and the second pump 102*b* is deficient, the ECU 104 operates the valve assembly 120 to be in the position for making a normal port turn as described in FIG. 4A.

Figure 6A:
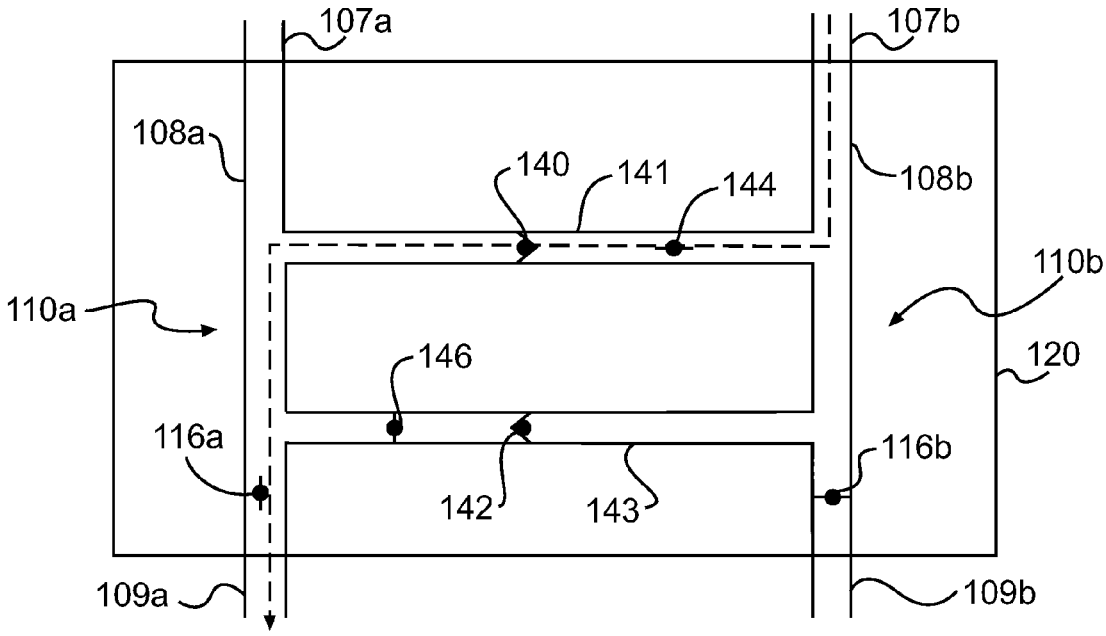
FIG. 6A is a schematic illustration of flow of hydraulic fluid supplied by the second pump (indicated by dashed arrows) through the valve assembly to the first side of the actuator of the hydraulic system of FIG. 2, according to a third mode of operation of the valve assembly.
Figure 6B:
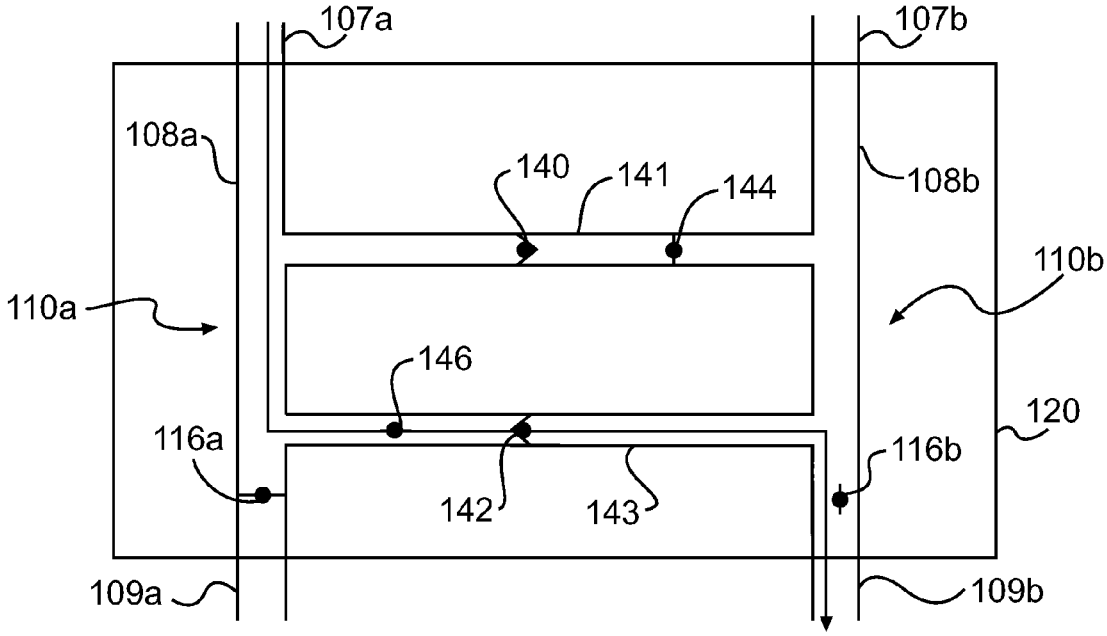
FIG. 6B is a schematic illustration of flow of hydraulic fluid supplied by the first pump (indicated by solid arrows) through the valve assembly to the second side of the actuator of the hydraulic system of FIG. 2, according to the third mode of operation of the valve assembly.

Turning now to FIGS. 6A and 6B, a third mode of operation of the valve assembly 120 will be described. The third mode corresponds to one of the pumps 102*a*, 102*b* having failed and the valve assembly 120 redirecting hydraulic fluid from the other pump 102*b*, 102*a* to supply the side of the actuator 106 that should have been supplied by the failed pump in order to make the turn.

FIG. 6A illustrates a position of the valve assembly 120 for making a port turn when the pump 102*a*, normally responsible for supplying the first side 112*a* of the actuator 106 to make a port turn, has failed.

When the operator acts on the watercraft 10 to make a port turn and a signal sent by the sensor 122*a* indicates failure of the first pump 102*a*, the ECU 104 sends a signal to the pump 102*b* to operate and to the valve assembly 120 to position the valves 116*b*, 116*a*, 144, and 146 as described in FIG. 5A. The valve assembly 120 redirects hydraulic fluid from the second fluid line 110*b* toward the first fluid line 110*a* as described in FIG. 5A. Since the first pump 102*a* is in failure, no hydraulic fluid originating from the first pump 102*a* flows in the valve assembly 120, and only the second pump 102*b* supplies the first fluid line 110*a* with hydraulic fluid for supplying the first side 112*a* of the actuator 106.

When the operator acts on the watercraft 10 to make a starboard turn and the first pump 102*a* has failed, the ECU 104 operates the valve assembly 120 to be in the position for making a normal starboard turn as described in FIG. 4B.

FIG. 6B illustrates a position of the valve assembly 120 for making a starboard turn when the pump 102*b*, normally responsible for supplying the second side 112*b* of the actuator 106 to make a starboard turn, has failed.

When the operator acts on the watercraft 10 to make a starboard turn and a signal sent by the sensor 122*b* indicates failure of the second pump 102*b*, the ECU 104 sends a signal to the pump 102*a* to operate and to the valve assembly 120 to be position the valves 116*b*, 116*a*, 144, and 146 like described in FIG. 5B. The valve assembly 120 redirects hydraulic fluid from the first fluid line 110*a* toward the second fluid line 110*b*. Since the second pump 102*b* has failed, no hydraulic fluid originating from the second pump 102*b* flows in the valve assembly 120, and only the first pump 102*a* supplies the second fluid line 110*b* with hydraulic fluid for supplying the second side 112*b* of the actuator 106.

When the operator acts on the watercraft 10 to make a port turn and the second pump 102*b* is in failure, the ECU 104 operates the valve assembly 120 to be in the position for making a normal starboard turn as described in FIG. 4A.

Figure 7A:
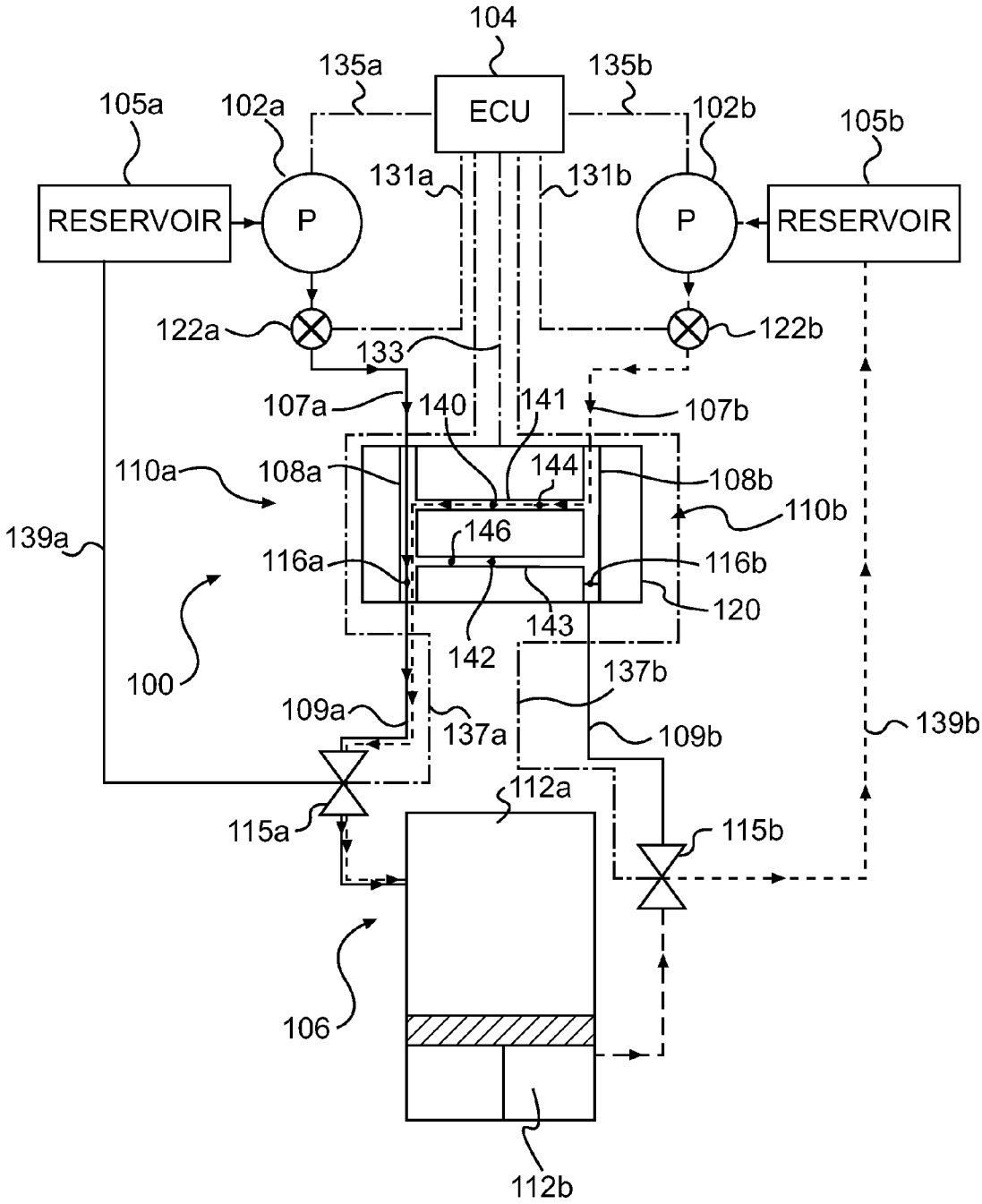
FIG. 7A is a schematic illustration of flow of hydraulic fluid supplied by the first and the second pumps (indicated by solid and dashed arrows respectively) through the hydraulic system of FIG. 2, according to the second mode of operation of the valve assembly illustrated in FIG. 5A.
Figure 7B:
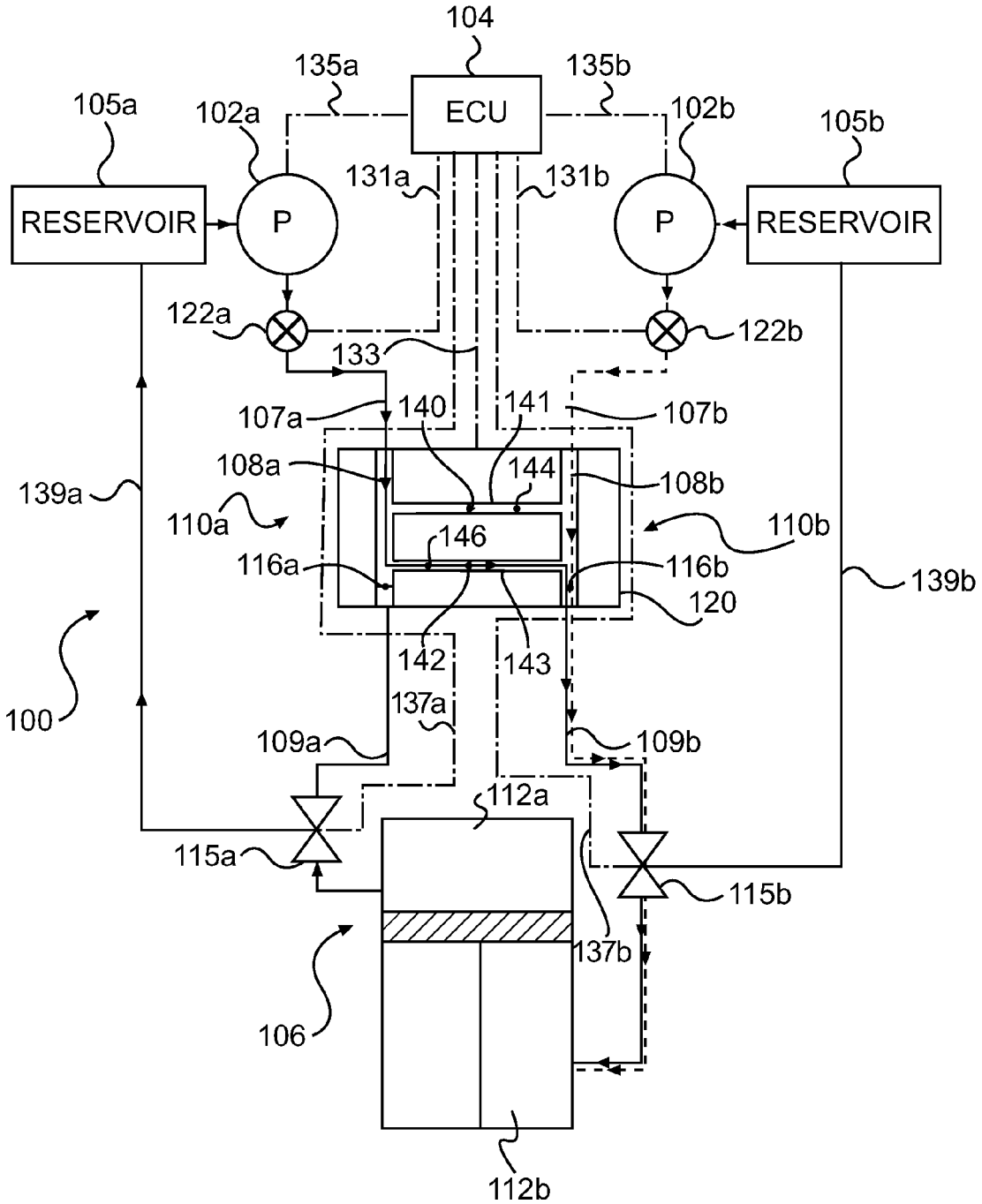
FIG. 7B is a schematic illustration of flow of hydraulic fluid supplied by the first and the second pumps (indicated by solid and dashed arrows respectively) through the hydraulic system of FIG. 2, according to the second mode of operation of the valve assembly illustrated in FIG. 5B.

FIGS. 7A and 7B show hydraulic fluid flowing in the hydraulic system 100 when the valve assembly 120 is in the position described above with respect to FIGS. 5A and 5B respectively.

In FIG. 7A, hydraulic fluid is redirected from the second fluid line 110*b* toward the first fluid line 110*a* for supplying the first side 112*a* of the actuator 106 for making a port turn. As hydraulic fluid fills the side 112*a* of the actuator 106, the side 112*a* expands due to an increase of hydraulic fluid in the side 112*a*. As a consequence the piston moves so as to reduce the volume of the side 112*b*. Hydraulic fluid that was contained in the side 112*b* is forced out and flows toward the valve 115*b*. The valve 115*b* is operated by the ECU 104 to be in a position for redirecting hydraulic fluid from the side 112*b* of the actuator 106 toward the reservoir 105*b* via the fluid line 139*b*.

In FIG. 7B, hydraulic fluid is redirected from the first fluid line 110*a* toward the second fluid line 110*b* for supplying the second side 112*b* of the actuator 106 for making a starboard turn. As hydraulic fluid fills the side 112*b* of the actuator 106, the side 112*b* expands due to an increase of hydraulic fluid in the side 112*b*. As a consequence the piston moves so as to reduce the volume of the side 112*a*. Hydraulic fluid that was contained in the side 112*a* is forced out and flows toward the valve 115*a*. The valve 115*a* is operated by the ECU 104 to be in a position for redirecting hydraulic fluid from the side 112*a* of the actuator 106 toward the reservoir 105*a* via the fluid line 139*a*.

Figure 8:
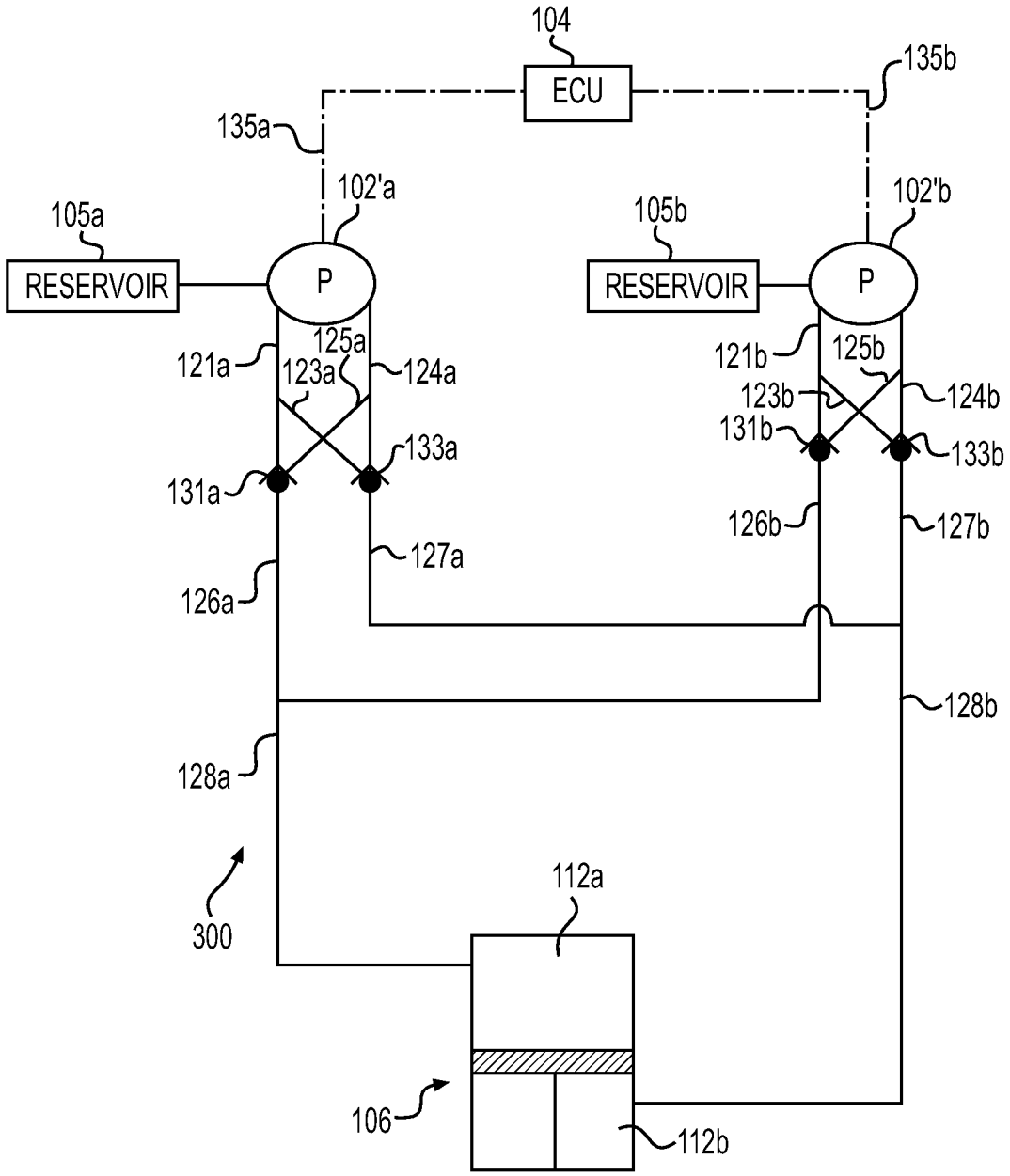
FIG. 8 is a schematic illustration of a hydraulic system according to a third embodiment of the invention.
Figure 9A:
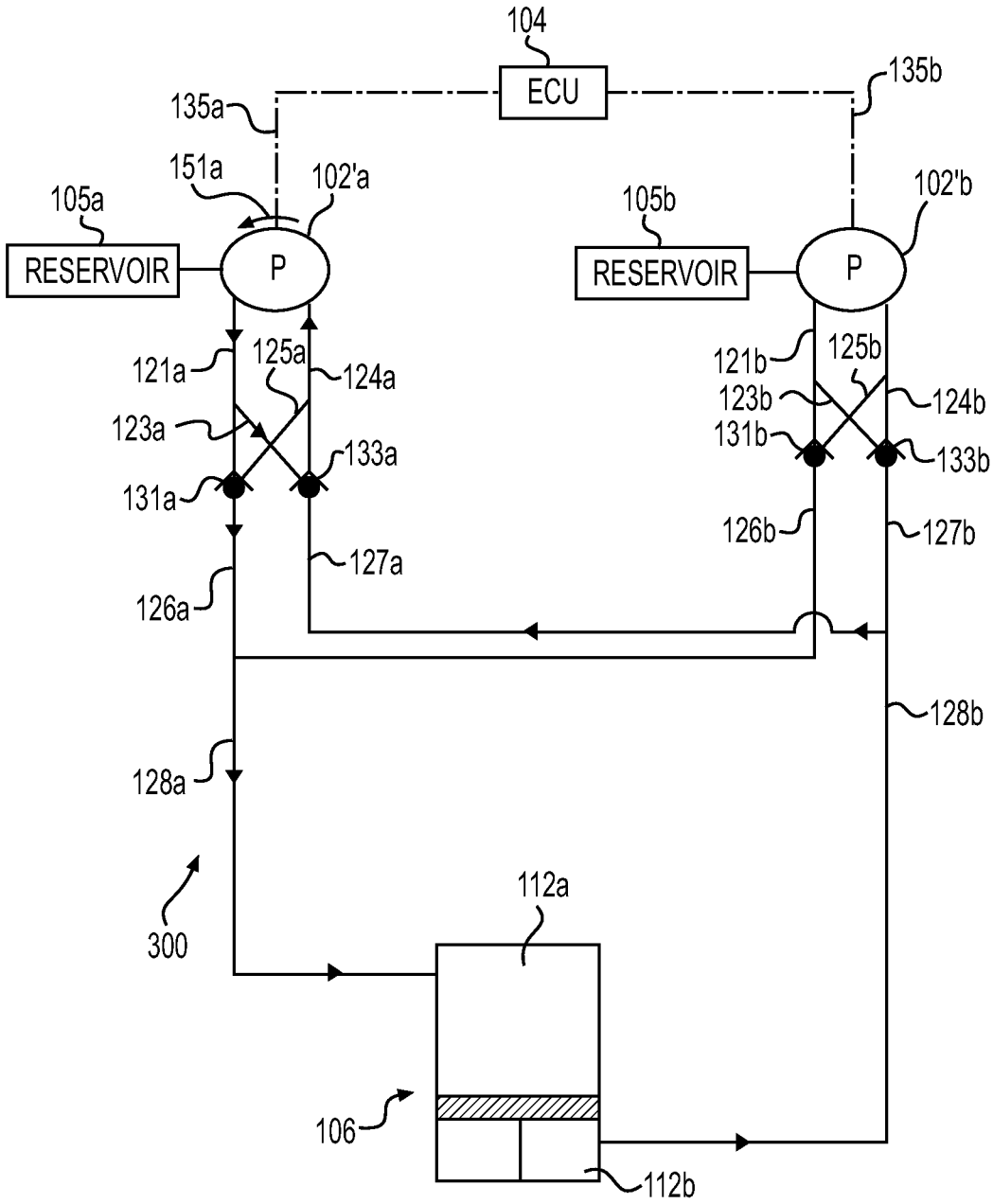
FIG. 9A is a schematic illustration of flow of hydraulic fluid supplied by the first pump (indicated by solid arrows) to a first side of the actuator through the hydraulic system of FIG. 8.
Figure 9B:
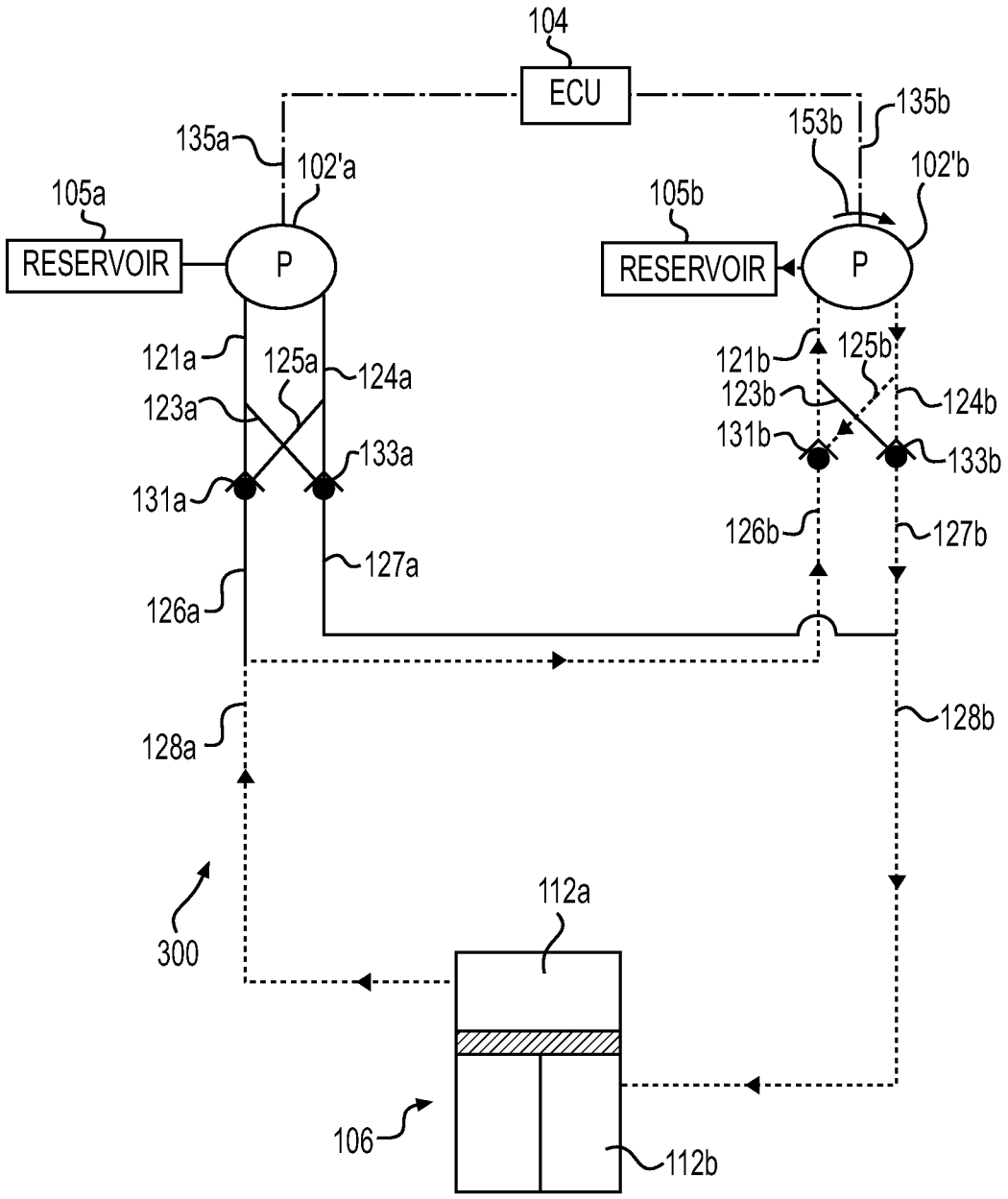
FIG. 9B is a schematic illustration of flow of hydraulic fluid supplied by the second pump (indicated by dashed arrows) to a second side of the actuator through the hydraulic system of FIG. 8.
Figure 9C:
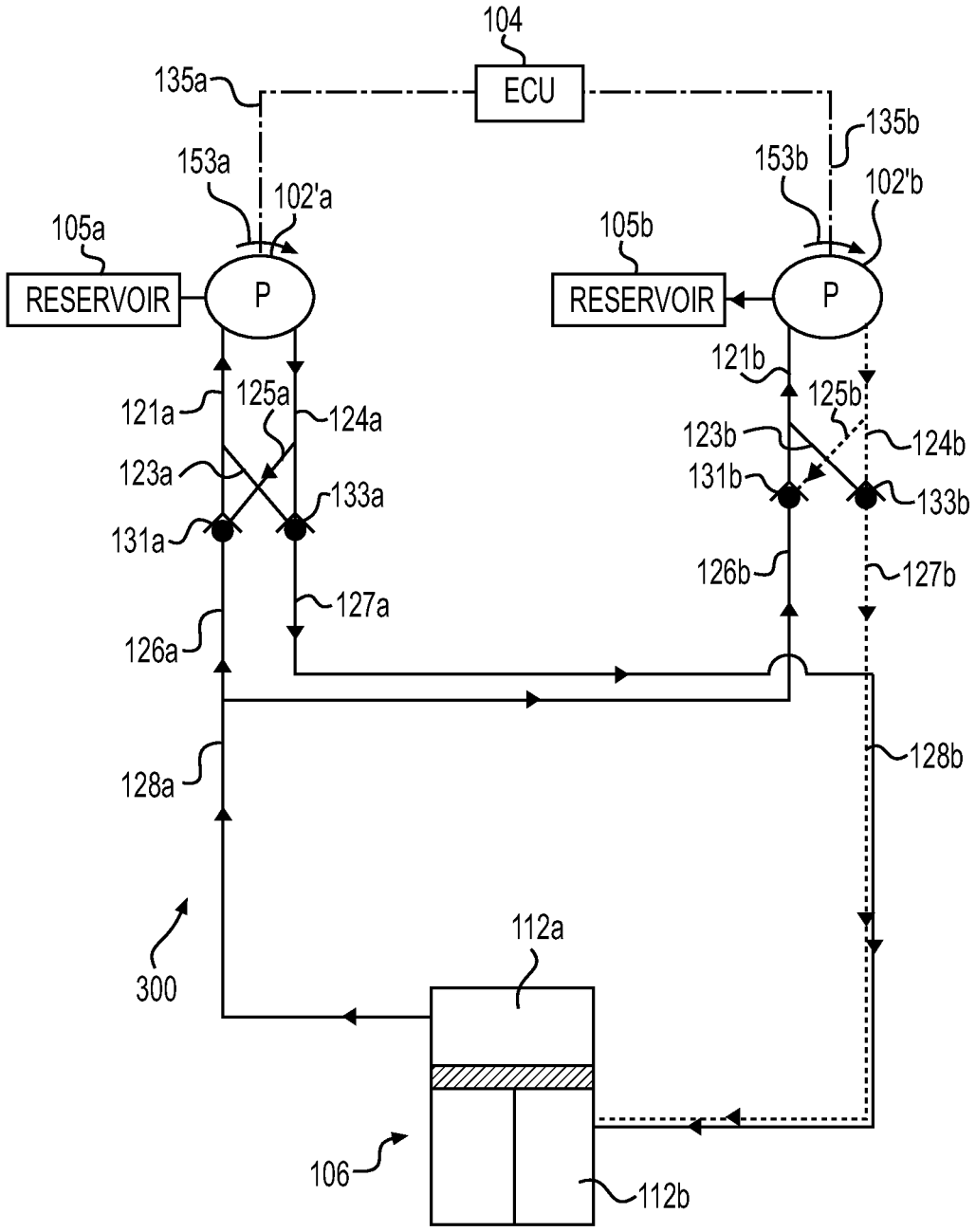
FIG. 9C is a schematic illustration of flow of hydraulic fluid supplied by the first and the second pumps (indicated by solid and dashed arrows respectively) to the second side of the actuator through the hydraulic system of FIG. 8.

Turning to FIGS. 8 to 9C, a hydraulic system 300 according to a third embodiment of the invention will be described. The hydraulic system 300 has common elements with the hydraulic systems 100 and 200. These common elements will be referred with the same reference numerals as the ones used to describe the hydraulic systems 100 and 200, and will not be described in details herein again.

Referring more specifically to FIG. 8, the hydraulic system 300 has a first bi-directional pump 102'*a* and a second bi-directional pump 102'*b*. The bi-directional pumps 102'*a*, 102'*b* each include an electric motor which allows each pump 102'*a*, 102'*b* to supply fluid in two distinct fluid lines depending on the direction of rotation imposed by the motor. The first bi-directional pump 102'*a* is electrically connected to the ECU 104 by the connection 135*a*, and the second bi-directional pump 102'*b* is electrically connected to the ECU 104 by the connection 135*b*. Each bi-directional pump 102'*a*, 102'*b* is fluidly connected to each side 112*a*, 112*b* of the actuator 106. Depending on an action requested by the operator (such as turning port or starboard), the ECU 104 communicates with the bi-directional pumps 102'*a*, 102'*b* to actuate one of the pumps 102'*a*, 102'*b* so as to provide hydraulic fluid to a corresponding side 112*a*, 112*b* of the actuator 106. Additionally, depending on information received by one or more sensors (e.g. pressure, flow rate, angular position) in the hydraulic system 300, the ECU 104 commands one of the pumps 102'*a*, 102'*b* to support the other one of the pumps 102'*a*, 102'*b* for providing hydraulic fluid to a corresponding side 112*b*, 112*a*. Hence, in the hydraulic system 300, no valve assembly 120 is needed to redirect hydraulic fluid.

The first bi-directional pump 102'*a* is connected to the reservoir 105*a*, and the second bi-directional pump 102'*b* is connected to the reservoir 105*b*. The reservoirs 105*a* and 105*b* are each connected to a pressure relief valve (not shown). It is contemplated that the pressure relief valve could be omitted.

Hydraulic fluid pumped from the reservoir 105*a* by the first pump 102'*a* can access a first fluid line 121*a* or a second fluid line 124*a* depending on the direction of rotation of the motor commanded by the ECU 104. A one way valve 131*a* is disposed on the first fluid line 121*a*, and a one way valve 133*a* is disposed on the second fluid line 124*a*. A fluid line 123*a* connects the one way valve 133*a* to the first fluid line 121*a*, and a fluid line 125*a* connects the one way valve 131*a* to the second fluid line 124*a*. When the ECU 104 controls the bi-directional pump 102'*a* to operate so as to pump hydraulic fluid from the reservoir 105*a* into to the fluid line 121*a*, hydraulic fluid accesses a fluid line 126*a* via the one way valve 131*a*. The fluid line 123*a* opens the one way valve 133*a* to allow flow back of hydraulic fluid to the reservoir 105*a*, as will be described below. Similarly, when the ECU 104 controls the bi-directional pump 102'*a* to operate so as to pump hydraulic fluid from the reservoir 105*a* into the fluid line 124*a*, hydraulic fluid accesses the fluid line 127*a* via the one way valve 133*a*. The fluid line 125*a* opens the one way valve 131*a* to allow flow back of hydraulic fluid to the reservoir 105*a*, as will be described below.

Similarly, hydraulic fluid pumped from the reservoir 105*b* by the second pump 102'*b* can access a first fluid line 121*b* or a second fluid line 124*b* depending on the direction of rotation of the motor commanded by the ECU 104. A one way valve 131*b* is disposed on the first fluid line 121*b*, and a one way valve 133*b* is disposed on the second fluid line 124*b*. A fluid line 123*b* connects the one way valve 133*b* to the first fluid line 121*b*, and a fluid line 125*b* connects the one way valve 131*b* to the second fluid line 124*b*. When the ECU 104 controls the bi-directional pump 102'*b* to operate so as to pump hydraulic fluid from the reservoir 105*b* into to the fluid line 121*b*, hydraulic fluid accesses a fluid line 126*b* via the one way valve 131*b*. The fluid line 123*b* opens the one way valve 133*b* to allow flow back of hydraulic fluid to the reservoir 105*b*, as will be described below. Similarly, when the ECU 104 controls the bi-directional pump 102'*b* to operate so as to pump hydraulic fluid from the reservoir 105*b* into the fluid line 124*b*, hydraulic fluid accesses the fluid line 127*b* via the one way valve 133*b*. The fluid line 125*b* opens the one way valve 131*b* to allow flow back of hydraulic fluid to the reservoir 105*b*, as will be described below.

The fluid line 126*a* is joined by the fluid line 126*b* downstream of the one way valves 131*a*, 131*b* to become fluid line 128*a*, which is connected to the side 112*a* of the actuator 106. The fluid line 127*b* is joined by the fluid line 127*a* downstream of the one way valves 133*a*, 133*b* to become fluid line 128*b* connected to the side 112*b* of the actuator 106. A manual override valve (not shown) selectively connects the fluid lines 128*a* and 128*b*. It is contemplated that manual override valve could be omitted.

The hydraulic system 300 contains at least one pressure relief valve (not shown).

Referring more specifically to FIGS. 9A to 9C, different modes of operation of the hydraulic system 300 will be described. In FIG. 9A is illustrated a normal mode of operation, where the first pump 102'*a* supplies hydraulic fluid to the side 112*a* of the actuator 106. In FIG. 9B is illustrated a normal mode of operation, where the second pump 102'*b* supplies hydraulic fluid to the side 112*b* of the actuator 106. In FIG. 9C is illustrated an assist mode of operation, where the first pump 102'*a* supplies hydraulic fluid to the side 112*b* of the actuator 106 to assist the second pump 102'*b* in supplying hydraulic fluid to the side 112*b* of the actuator 106. The assist mode of operation is used, for example, when the second pump 102'*b* is deficient.

Referring more specifically to FIG. 9A, the first bi-directional pump 102'*a* is pumping in a first direction 151*a* (illustrated by arrow 151*a* in FIG. 9A) to supply the side 112*a* of the actuator 106 with hydraulic fluid. It should be understood, that the second bi-directional pump 102'*b* and the one way valves 131*b*, 133*b* would operate similarly when the second bi-directional pump 102'*b* is actuated to pump in a first direction (not shown) so as to supply the side 112*a* of the actuator 106 with hydraulic fluid. When the ECU 104 commands the pump 102'*a* to pump in the first direction 151*a*, hydraulic fluid is supplied from the reservoir 105*a* to the fluid line 121*a*. A portion of the hydraulic fluid of the fluid line 121*a* is directed into the fluid line 123*a* to open the one way valve 133*a*. The one way valve 133*a* is maintained open to allow hydraulic fluid to flow back from the side 112*b* of the actuator 106 to the reservoir 105*a*. The fluid line 121*a* connects with the fluid line 126*a* via the one way valve 131*a*, and supplies the side 112*a* of the actuator 106 via the fluid line 128*a*. As hydraulic fluid fills in the side 112*a* of the actuator 106, the side 112*b* of the actuator 106 decreases in volume, and hydraulic fluid leaves the side 112*b* via the fluid line 128*b*. The fluid line 128*b* connects with the fluid line 127*a*. Because the valve 133*a* is maintained in an opened position by hydraulic fluid in the fluid line 123*a*. The fluid line 127*b* connects to the fluid line 124*a* and hydraulic fluid reach the reservoir 105*a*.

Referring more specifically to FIG. 9B, the second bi-directional pump 102'*b* is pumping in a second direction 153*b* (illustrated by arrow 153*b* in FIG. 9B) to supply the side 112*b* of the actuator 106 with hydraulic fluid. It should be understood, that the first bi-directional pump 102'*a* and the one way valves 131*a*, 133 *a* would operate similarly when the first bi-directional pump 102'*a* is actuated to pump in a second direction 153*a* (shown in FIG. 9C) so as to supply the side 112*b* of the actuator 106 with hydraulic fluid. When the ECU 104 commands the pump 102'*b* to pump in the second direction 153*b*, hydraulic fluid is supplied from the reservoir 105*b* to the fluid line 124*b*. A portion of the hydraulic fluid of the fluid line 124*b* is directed into the fluid line 125*b* to open the one way valve 131*b*. The one way valve 131*b* is maintained open to allow hydraulic fluid to flow back from the side 112*a* of the actuator 106 to the reservoir 105*b*. The fluid line 124*b* connects with the fluid line 127*b* via the one way valve 133*b*, and supplies the side 112*b* of the actuator 106 via the fluid line 128*b*. As hydraulic fluid fills in the side 112*b* of the actuator 106, the side 112*a* of the actuator 106 decreases in volume, and hydraulic fluid leaves the side 112*a* via the fluid line 128*a*. The fluid line 128*a* connects with the fluid line 126*b*. Because the valve 131*b* is maintained in an opened position by hydraulic fluid in the fluid line 125*a*. The fluid line 126*b* connects to the fluid line 121*b* and hydraulic fluid reach the reservoir 105*b*.

Referring more specifically to FIG. 9C, the first bi-directional pump 102'*a* is pumping in the second direction 153*a* to supply the side 112*b* of the actuator 106 with hydraulic fluid so as to support the second bi-directional pump 102'*b* already pumping in the second direction 153*b*. It should be understood, that in a similar manner, the second bi-directional pump 102'*b* could pump in the first direction to supply the side 112*a* of the actuator 106 with hydraulic fluid so as to support the first bi-directional pump 102'*a* pumping in the first direction 151*a*. The ECU 104 commands the first pump 102'*a* to operate in the second direction 153*a* to assist the second pump 102'*b* when information from a pressure fluid sensor (not shown) in the hydraulic system 300 indicates that additional hydraulic fluid needs to be supplied to the side 112*b*. This is the case, for example, when the second pump 102'*b* is deficient or that a turn exceeding a certain range of operation is initiated. It is contemplated that information could alternatively come from a flow meter, a position sensor or an angular sensor. It is contemplated that, upon receiving information that one of the pumps 102'*a*, 102'*b* is not working properly, the ECU 104 could command the non properly working pump 102'*a*, 102'*b* to stop pumping, and could command the other pump 102'*a*, 102'*b* (which is working properly) to provide hydraulic fluid to the side 112*a*, 112*b* of the actuator 106 corresponding to the side that would be provided by hydraulic fluid by the non properly working pump 102'*a*, 102'*b*.

The second pump 102'*b* is actuated to pump in the second direction 153*b*. As described above, the second pump 102'*b* pumps fluid from the reservoir 105*b*, and supplies the fluid line 124*b*. A portion of the hydraulic fluid of the fluid line 124*b* is directed into the fluid line 125*b* to open the one way valve 131*b*. The fluid line 124*b* connects with the fluid line 127*b* via the one way valve 133*b*, and supplies the side 112*b* of the actuator 106 via the fluid line 128*b*. As hydraulic fluid fills in the side 112*b* of the actuator 106, the side 112*a* of the actuator 106 decreases in volume, and hydraulic fluid leaves the side 112*a* via the fluid line 128*a*. The fluid line 128*a* connects with the fluid line 126*b* which due the valve 131*b* being maintained in an opened position connects to the fluid line 121*b* to carry hydraulic fluid to the reservoir 105*b*.

The first pump 102'*a* is actuated to pump in the second direction 153*a*. The first pump 102'*a* pumps fluid from the reservoir 105*a*, and supplies the fluid line 124*a*. A portion of the hydraulic fluid of the fluid line 124*a* is directed into the fluid line 125*a* to open the one way valve 131*a*. The one way valve 131*a* is maintained open to allow fluid to flow back from the side 112*a* of the actuator 106 to the reservoir 105*a*. The fluid line 124*a* connects with the fluid line 127*a* via the one way valve 133*a*, and supplies the side 112*b* of the actuator 106 via the fluid line 128*b*. As hydraulic fluid fills in the side 112*b* of the actuator 106, hydraulic fluid leaves the side 112*a* via the fluid line 128*a*. The fluid line 128*a* connects with the fluid line 126*a* which thanks to the valve 131*a* being maintained in an opened position connects to the fluid line 121*a* to carry hydraulic fluid to the reservoir 105*a*. The fluid line 128*a* also connects with the fluid line 126*b* which thanks to the valve 131*b* being maintained in an opened position connects to the fluid line 121*a* to carry hydraulic fluid to the reservoir 105*a*. Since the fluid line 128*b* is supplied by the fluid line 127*a* coming from the first pump 102'*a* and from the fluid line 127*b* coming from the second pump 102'*b*, it results that more fluid is fed into the side 112*b* than if the second pump 102'*b* was pumping by itself.

Figure 10:
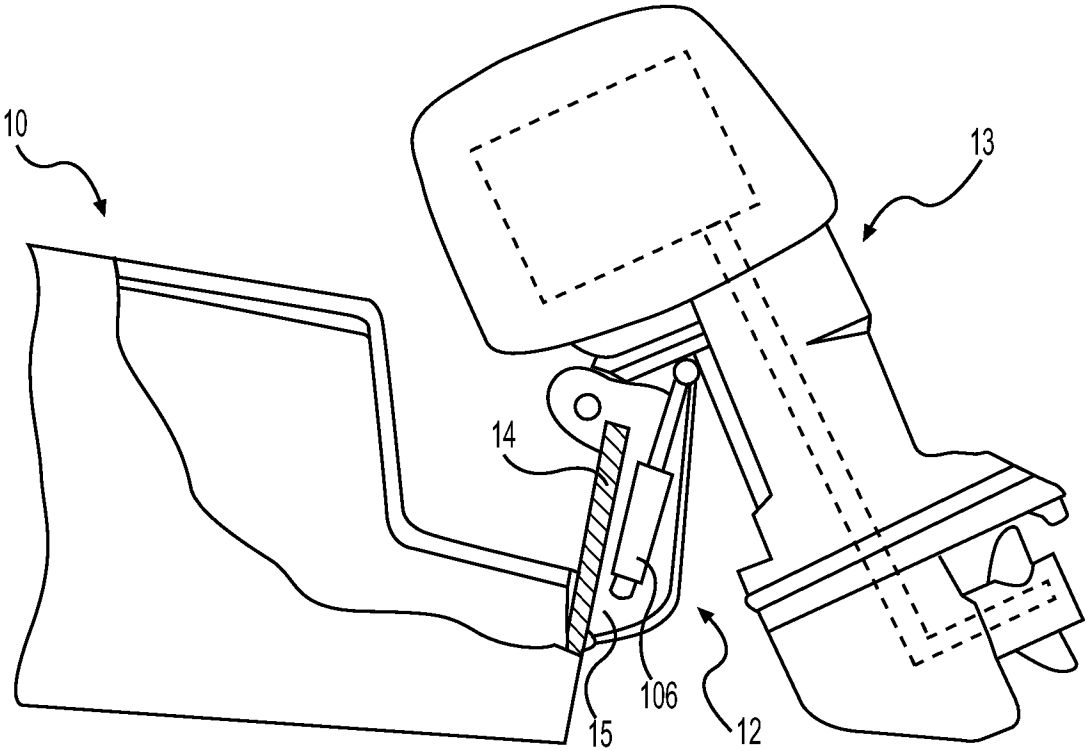
FIG. 10 shows a watercraft with a tilt/trim system for an outboard engine with an actuator thereof being hydraulically actuated according to the present invention.
Figure 11:
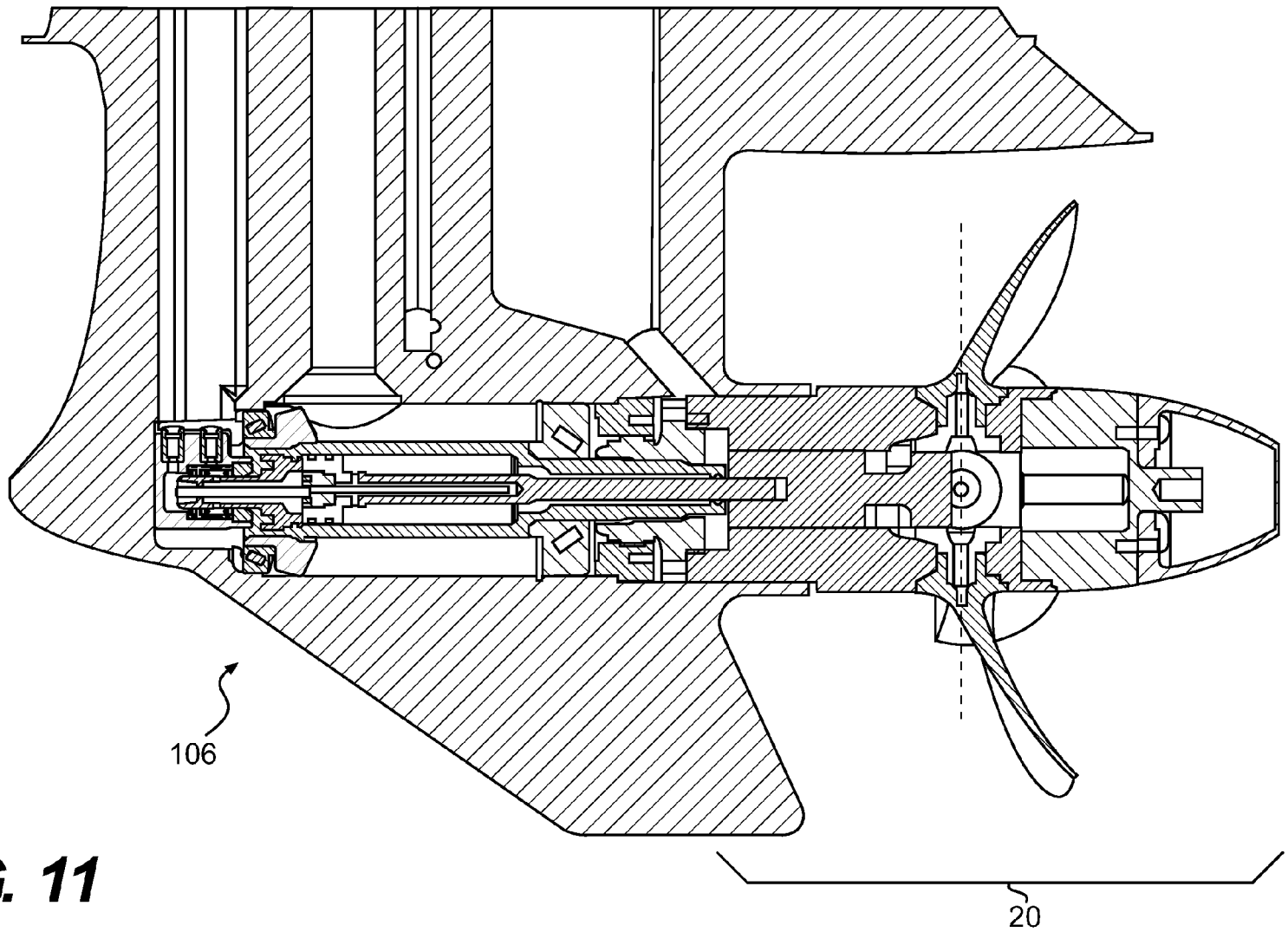
FIG. 11 shows a variable pitch propeller system with an actuator thereof being hydraulically actuated according to the present invention.
Figure 12:
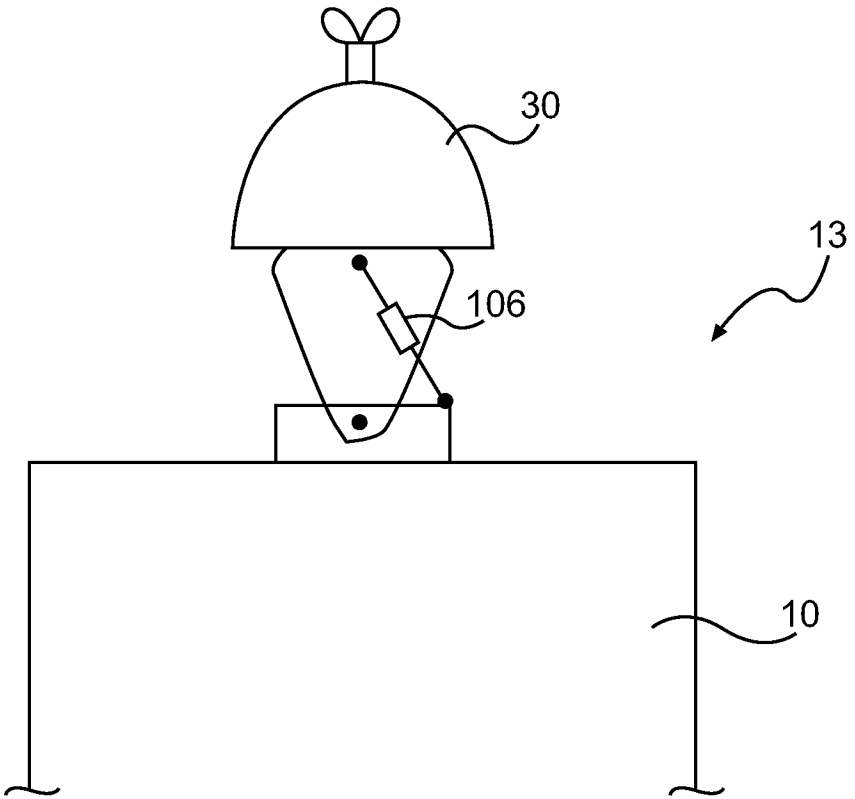
FIG. 12 shows a steering system with an actuator hydraulically actuated according to the present invention.

FIGS. 10 to 12 show examples of implementation of the present invention on the watercraft 10.

FIG. 10 shows the watercraft 10 with a tilt/trim system 12 for the outboard engine 13. The tilt/trim system 12 has the actuator 106 located on a bracket 15 of a transom 14 of the watercraft 10.

FIG. 11 shows a variable pitch propeller system 20 operated by the actuator 106 in the form of a linear hydraulic actuator.

FIG. 12 shows the steering system 30 of the outboard engine 13 operated by the actuator 106.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A hydraulic system for a marine propulsion system comprising:

an actuator adapted for moving at least a portion of the propulsion system between a first position and a second position;

a first pump selectively communicating with the actuator by a first fluid line, when in operation the first pump supplying hydraulic fluid via the first fluid line to the actuator for moving at least the portion of the propulsion system towards the first position;

a second pump selectively fluidly communicating with the actuator by a second fluid line, when in operation the second pump supplying hydraulic fluid via the second fluid line to the actuator for moving at least the portion of the propulsion system towards the second position;

a third fluid line selectively communicating the first pump to the actuator for moving at least the portion of the propulsion system towards the second position;

at least one sensor sensing at least one of hydraulic pressure and flow rate in the second fluid line; and an electronic control unit (ECU) electrically connected to the first pump and to the second pump for controlling the operation of the first pump and the second pump;

wherein when the ECU receives a signal from the at least one sensor indicative of at least one of hydraulic pressure and flow rate in the second fluid line being insufficient for moving at least the portion of the propulsion system toward the second position, the ECU sends a signal to the first pump to supply hydraulic fluid via the third fluid line to the actuator for moving at least the portion of the propulsion system towards the second position.

2. The hydraulic system of claim 1, further comprising:

a fourth fluid line selectively communicating the second pump to the actuator for moving at least the portion of the propulsion system towards the first position, the at least one sensor sensing at least one of hydraulic pressure and flow rate in the first fluid line; and wherein when the ECU receives a signal from the at least one sensor indicative of at least one of hydraulic pressure and flow rate in the first fluid line being insufficient for moving at least the portion of the propulsion system toward the first position, the ECU sends a signal to the second pump to supply hydraulic fluid via the fourth fluid line to the actuator for moving at least the portion of the propulsion system towards the first position.

3. The hydraulic system of claim 2, wherein the signal from the at least one sensor indicative of at least one of hydraulic pressure and flow rate in the first fluid line being insufficient for moving at least the portion of the propulsion system toward the first position is indicative of the first pump not functioning properly; and the signal from the at least one sensor indicative of at least one of hydraulic pressure and flow rate in the second fluid line being insufficient for moving at least the portion of the propulsion system toward the second position is indicative of the second pump not functioning properly.

4. The hydraulic system of claim 2, wherein the first pump and the second pump are bi-directional pumps.

5. The hydraulic system of claim 1, wherein the actuator is one of a linear and a rotary actuator, the actuator including a piston disposed in a cylinder, the first fluid line supplying hydraulic fluid in the cylinder to a first side of the piston, and the second fluid line supplying hydraulic fluid in the cylinder to a second side of the piston.

6. The hydraulic system of claim 1, wherein the first and second pumps include an electric motor.

7. The hydraulic system of claim 1, wherein the actuator controls at least one of a steering system, a tilt-trim system, and a variable pitch propeller actuation system.

8. The hydraulic system of claim 1, further comprising at least one reservoir in fluid communication with at least one of the first pump and the second pump.

9. The hydraulic system of claim 1, wherein the hydraulic system is adapted to be located in a tilt/trim bracket of a watercraft.

10. The hydraulic system of claim 1, wherein the first position of the propulsion system is in a different direction from the second position of the propulsion system.

11. A hydraulic system for a marine propulsion system comprising:

an actuator adapted for moving at least a portion of the propulsion system between a first position and a second position;

a first pump selectively communicating with the actuator by a first fluid line, when in operation the first pump supplying hydraulic fluid via the first fluid line to the actuator for moving at least the portion of the propulsion system towards the first position;

a second pump selectively fluidly communicating with the actuator by a second fluid line, when in operation the second pump supplying hydraulic fluid via the second fluid line to the actuator for moving at least the portion of the propulsion system towards the second position;

an electronic control unit (ECU) electrically connected to the first pump and to the second pump for controlling the operation of the first pump and the second pump; and a valve assembly electrically connected to the ECU, the valve assembly selectively fluidly communicating the first fluid line with the second fluid line.

12. The hydraulic system of claim 11, further comprising at least one sensor electrically connected to the ECU; and wherein when the ECU receives a signal from the at least one sensor indicative of at least one of hydraulic pressure and flow rate in the first fluid line being insufficient for moving at least the portion of the propulsion system toward the first position, the ECU sends a signal to the valve assembly to redirect hydraulic fluid from the second fluid line toward the first fluid line, and the ECU sends a signal to the second pump to operate.

13. The hydraulic system of claim 12, further comprising at least one valve positioned on the second fluid line, when the at least one valve is in a closed position, the at least one valve prevents flow in the second fluid line toward the actuator; and wherein when the ECU receives a signal from the at least one sensor of hydraulic pressure in the first fluid line being insufficient for moving at least the portion of the propulsion system toward the first position, the ECU sends a signal to close the at least one valve to prevent hydraulic fluid to flow in the second fluid line toward the actuator.

14. The hydraulic system of claim 13, wherein the valve assembly comprises the at least one valve.

15. The hydraulic system of claim 12, wherein the signal from the at least one sensor indicative of at least one of hydraulic pressure and flow rate in the first fluid line being insufficient for moving at least the portion of the propulsion system toward the first position is indicative of the first pump not functioning properly.

16. The hydraulic system of claim 11, further comprising at least one sensor electrically connected to the ECU; and wherein when the ECU receives a signal from the at least one sensor indicative of at least one of hydraulic pressure and flow rate in the second fluid line being insufficient for moving the at least portion of the propulsion system toward the second position, the ECU sends a signal to the valve assembly to redirect hydraulic fluid from the first fluid line toward the second fluid line, the ECU sends a signal to the first pump to actuate, a combined action of the valve assembly redirecting hydraulic fluid toward the second fluid line and an actuation of the first pump resulting in moving the at least portion of the propulsion system toward the second position.

17. The hydraulic system of claim 16, further comprising at least a valve positioned on the first fluid line, when the at least valve is in a closed position the at least valve preventing flow in the second fluid line toward the actuator; and wherein when the ECU receives a signal from the at least one sensor of hydraulic pressure in the second fluid line being insufficient for moving at least the portion of the propulsion system toward the second position, the ECU sends a signal to close the at least valve to prevent hydraulic fluid to flow in the first fluid line toward the actuator.

18. The hydraulic system of claim 17, wherein the at least valve is comprised in the valve assembly.

19. The hydraulic system of claim 16, wherein the signal from the at least one sensor indicative of at least one of hydraulic pressure and flow rate in the second fluid line being insufficient for moving at least the portion of the propulsion system toward the second position is indicative of the second pump not functioning properly.

20. The hydraulic system of claim 11, wherein the actuator is one of a linear and a rotary actuator, the actuator including a piston disposed in a cylinder, the first fluid line supplying hydraulic fluid in the cylinder to a first side of the piston, and the second fluid line supplying hydraulic fluid in the cylinder to a second side of the piston.

21. The hydraulic system of claim 11, wherein the first and second pumps include an electric motor.

22. The hydraulic system of claim 11, wherein the actuator controls at least one of a steering system, a tilt-trim system, and a variable pitch propeller actuation system.

23. The hydraulic system of claim 11, further comprising at least one reservoir in fluid communication with at least one of the first pump and the second pump.

24. The hydraulic system of claim 11, wherein the hydraulic system is adapted to be located in a tilt/trim bracket of a watercraft.

25. The hydraulic system of claim 11, wherein the first position of the propulsion system is in a different direction from the second position of the propulsion system.

* * * * *